US006988723B2

(12) United States Patent
Kitami et al.

(10) Patent No.: US 6,988,723 B2
(45) Date of Patent: Jan. 24, 2006

(54) FEEDING AND CONVEYING DEVICE WITH WAIT POSITION

(75) Inventors: Kenji Kitami, Kashihara (JP); Kazuo Nakamura, Kashiba (JP); Souichi Takata, Kitakatsuragi-gun (JP); Hiroyuki Nagao, Yamabe-gun (JP)

(73) Assignee: Sharp Kabushiki Kaisha, Osaka (JP)

( * ) Notice: Subject to any disclaimer, the term of this patent is extended or adjusted under 35 U.S.C. 154(b) by 181 days.

(21) Appl. No.: 10/448,208

(22) Filed: May 30, 2003

(65) Prior Publication Data

US 2003/0222395 A1 Dec. 4, 2003

(30) Foreign Application Priority Data

May 30, 2002 (JP) ..... P2002-157859

(51) Int. Cl.
*B65H 3/06* (2006.01)

(52) U.S. Cl. ..... 271/127; 271/117; 271/162

(58) Field of Classification Search ..... 271/126, 271/127, 117, 162
See application file for complete search history.

(56) References Cited

U.S. PATENT DOCUMENTS 3,955,811 A * 5/1976 Gibson ..... 271/9.05
5,383,654 A * 1/1995 Iseda ..... 271/9.05
6,091,927 A * 7/2000 Hattori et al. ..... 399/367
2003/0085506 A1 * 5/2003 Kubo ..... 271/117

FOREIGN PATENT DOCUMENTS

JP 02-163227 A 6/1990
JP 4-260547 A 9/1992
JP 10-194502 A 7/1998
JP 411352608 A * 12/1999
JP 2003118851 A * 4/2003

* cited by examiner

*Primary Examiner*—Patrick Mackey
(74) *Attorney, Agent, or Firm*—Birch, Stewart, Kolasch & Birch, LLP

(57) ABSTRACT

A sheet member feeding and conveying apparatus has a tray having a tray main body capable of displacement in directions close to and away from a pickup section for taking out a document in the take-out position. There is a tray driving section for driving the tray main body to be displaced in the directions close to and away from the pickup section. A control section is provided for controlling the tray driving section so as to, in a feeding state, drive the tray main body to be displaced so that a document closest to the pickup section held on the tray is placed in the take-out position, and in a waiting state, drive the tray main body to be displaced in a waiting position closer to the pickup section than a position where the maximum holding amount of documents are held on the tray.

9 Claims, 7 Drawing Sheets

FEEDING AND CONVEYING DEVICE WITH WAIT POSITION

BACKGROUND OF THE INVENTION

1. Field of the Invention

The invention relates to a sheet member feeding and conveying apparatus which is mounted on an image reading apparatus, an image forming apparatus and the like and which conveys a sheet member such as a document and a recording sheet.

2. Description of the Related Art

An image reading apparatus which reads an image formed on a document by automatically conveying one document or a plurality of documents sequentially to an image reading section provided with an image sensor, and an image forming apparatus which forms an image on a recording sheet by automatically conveying one recording sheet or a plurality of recording sheets sequentially to an image forming section provided with an inkjet head are equipped with sheet member feeding and conveying apparatuses in order to read an image and form an image effectively. As digital technology progresses, the time between reading an image of a document and conversion to digital data and the time for forming an image from digital data on a recording sheet are shortened. Moreover, in an image reading apparatus and an image forming apparatus, in order to efficiently feed and convey a lot of sheet members including documents and recording sheets, the number of sheet members which can be held in a sheet member feeding and conveying apparatus at a time has remarkably increased, which is 100 or more in the case of a copy sheet of 62 g/m$^2$ by basis weight, for example.

As such a prior art, a paper feeding apparatus provided with a deck on which a large number of sheet members can be placed and capable of manual paper feeding is disclosed in Japanese Unexamined Patent Publication JP-A 2-163227 (1990). Moreover, as another prior art, a paper feeding apparatus provided with a paper feeding table on which a large number of sheet members can be placed is disclosed in Japanese Unexamined Patent Publication JP-A 4-260547 (1992). Furthermore, as still another prior art, an automatic sheet material feeder provided with a document tray on which a plurality of sheet materials are placed is disclosed in Japanese Unexamined Patent Publication JP-A 10-194502 (1998).

In the aforementioned prior arts, a tray is placed in a waiting position where the spacing between a placed face of the tray and a pickup roller is the largest so that the user can make the tray hold the tray's maximum holding amount of sheet members when loading sheet members on the tray. Since the tray is placed in a waiting position even when the user loads and makes a few sheet members held, time of at least one second or more is required for displacing the tray from a waiting position to a position where the sheet members are placed in a take-out position where the pickup roller can take out the sheet members held on the tray. Therefore, the aforementioned time for displacing the tray is added to the duration from the time when the user makes sheet members held on the tray to the time when images formed on the sheet members are read or images are formed on sheet members, with the result that the time required for an image reading process and an image forming process becomes long. Particularly, in an image reading apparatus, it is exceedingly rare to read the maximum amount of sheet members which can be held on the tray, and the amount of sheet members to be read is normally one, a few or dozens at most.

SUMMARY OF THE INVENTION

Accordingly, an object of the invention is to provide a sheet member feeding and conveying apparatus which enables shortening the required duration from the time when a sheet member is held on a tray to the time when the sheet member is taken out of the tray by pickup means.

The invention provides a sheet member feeding and conveying apparatus comprising:

pickup means for taking out a sheet member placed in a predetermined take-out position;

a tray having a tray main body capable of displacement in directions close to and away from the pickup means, for holding sheet members;

tray driving means for driving the tray main body to be displaced in the directions close to and away from the pickup means; and control means for controlling the tray driving means so as to, in a feeding state of feeding sheet members held on the tray, drive the tray main body to be displaced so that a sheet member closest to the pickup means held on the tray is placed in the take-out position, and in a waiting state of waiting for loading of sheet members on the tray, drive the tray main body to be displaced into a waiting position which is closer to the pickup means than a position at a time when a maximum holding amount of sheet members are held on the tray.

According to the invention, the tray main body is driven by the tray driving means controlled by the control means, in the waiting state of waiting for loading of sheet members on the tray, to be displaced into a waiting position closer to the pickup means than the position at the time when the maximum holding amount of sheet members are held on the tray, and in the feeding state of feeding sheet members held on the tray, to be displaced so that the sheet member closest to the pickup means held on the tray is placed in the take-out position.

Since the amount of displacement from the waiting position closer to the pickup means than the position at the time when the maximum holding amount of sheet members are held on the tray to the position where the sheet member closest to the pickup means held on the tray is placed in the take-out position is smaller than the amount of displacement from the waiting position at the time when the maximum holding amount of sheet members are held on the tray to the position where the sheet member closest to the pickup means held on the tray is placed in the take-out position, it is possible to shorten the duration from the time when a smaller amount than the tray's maximum holding amount of sheet members, for example, a few sheet members are loaded on the tray to the time when a sheet member is taken out by the pickup means.

Since the amount of sheet members handled in, for example, an image reading apparatus which reads images formed on sheet members is sufficiently smaller than the tray's maximum holding amount in general, it is possible to execute an image reading process at a high speed, by equipping the image reading apparatus with the sheet member feeding and conveying apparatus of the invention.

Further, in the invention it is preferable that the apparatus further comprises waiting position input means for inputting a waiting position, and that, in the waiting state, the control means controls the tray driving means so as to drive the tray main body to be displaced into a waiting position inputted by the waiting position input means.

According to the invention, in the waiting state, the tray main body is driven by the tray driving means to be displaced into a waiting position inputted by the waiting position input means, by inputting the waiting position in response to the amount of sheet members, for example, with the result that it is possible to certainly shorten the duration from the time when sheet members are loaded on the tray to the time when a sheet member is taken out by the pickup means.

Still further, in the invention it is preferable that the apparatus further comprises waiting position determining means for determining a waiting position based on the amount of sheet members loaded on the tray in a take-out operation executed before.

According to the invention, a waiting position is determined by the waiting position determining means based on the amount of sheet members loaded on the tray in a take-out operation executed before, with the result that it is possible to automatically determine a waiting position and shorten the duration from the time when sheet members are loaded on the tray to the time when a sheet member is taken out by the pickup means.

Still further, in the invention it is preferable that the pickup means is capable of displacement between a pickup position where a sheet member placed in a take-out position can be taken out and an evacuation position evacuated from the pickup position, the apparatus further comprises pickup driving means for driving the pickup means to be displaced between the pickup position and the evacuation position, and that the control means controls the pickup driving means so as to, in the feeding state, place the pickup means into the pickup position, and in the waiting state, place the pickup means into the evacuation position.

According to the invention, the pickup means is driven to be displaced between the pickup position and the evacuation position so as to be, in the feeding state, placed in the pickup position where a sheet member placed in the take-out position can be taken out, and in the waiting state, placed in the evacuation position evacuated from the pickup position. When the pickup means is placed in the evacuation position, the user can easily remove sheet members held on the tray from the tray. Therefore, for example, when an undesired sheet member is loaded on the tray by mistake, the user can easily remove the sheet member held on the tray from the tray and easily reload a desired sheet member on the tray, with the result that it is possible to prevent that an undesired sheet member is taken out by the pickup means and processed.

Still further, in the invention it is preferable that the apparatus further comprises sheet member detecting means for detecting that a sheet member is held on the tray, and that, in the waiting state, when the sheet member detecting means detects that a sheet member is loaded on the tray, the control means controls the pickup driving means so as to place the pickup means placed in the evacuation position into the pickup position after a lapse of preset loading completion waiting time for waiting for a time between loading of a sheet member and completion of loading.

According to the invention, in the waiting state, when the sheet member detecting means detects that a sheet member is loaded on the tray, the pickup means placed in the evacuation position is placed into the pickup position after the lapse of predetermined loading completion waiting time after the sheet member is loaded.

In a case where the pickup means placed in the evacuation position is placed into the pickup position right after it is detected that a sheet member is loaded on the tray, once a sheet member is loaded on the tray, the held sheet member cannot be removed from the tray because of the pickup means placed in the pickup position. However, since the pickup means is placed into the pickup position after the lapse of loading completion waiting time after it is detected that a sheet member is loaded on the tray, the pickup means is placed in the evacuation position during the loading completion waiting time, and therefore, the user can easily remove a sheet member from the tray. As a result, for example, when an undesired sheet member is loaded on the tray by mistake, the user can easily remove during loading completion waiting time, and it is possible to prevent that an undesired sheet member is taken out by the pickup means and processed.

Still further, in the invention it is preferable that the apparatus further comprises loading completion waiting time input means for inputting loading completion waiting time.

According to the invention, loading completion waiting time is inputted by the loading completion waiting time input means, so that the user can set loading completion waiting time depending on the ability of the user.

Still further, in the invention it is preferable that the apparatus further comprises take-out request input means for inputting a request for taking out a sheet member, and that the control means controls the pickup driving means so as to displace the pickup means into the evacuation position in a case where, after the pickup means is displaced from the evacuation position into the pickup position, a take-out request is not inputted after a lapse of preset request waiting time for waiting for input of a take-out request.

According to the invention, in the case where, after the pickup means is displaced from the evacuation position into the pickup position, a take-out request is not inputted after the lapse of preset request waiting time for waiting for input of the take-out request, the pickup means is displaced into the evacuation position. Thus, for example, the case where a take-out request is not inputted after the lapse of request waiting time after the pickup means is displaced into the pickup position is thought to be, for example, a case where an operation of taking out a sheet member by the pickup means is not performed and a case where a sheet member is added and loaded on the tray. Therefore, in this case, the pickup means is placed in the evacuation position, so that it is possible to easily and quickly remove and load a sheet member.

Still further, in the invention it is preferable that the apparatus further comprises request waiting time input means for inputting request waiting time.

According to the invention, request waiting time is inputted by the request waiting time input means, so that the user can set request waiting time depending on the ability of the user.

Still further, in the invention it is preferable that the apparatus further comprises feeding request input means for inputting a request for feeding a sheet member, and that when a feeding request is inputted, the control means controls the pickup driving means so as to displace the pickup means placed in the evacuation position into the pickup position, and after displacement into the pickup position, controls the pickup means so as to take out a sheet member placed in the take-out position.

According to the invention, when a feeding request is inputted by the feeding request input means, the pickup means is displaced from the evacuation position into the pickup position, and after that, controlled so as to take out a sheet member placed in the take-out position. Thus, the pickup means is placed in the evacuation position during the time between loading of a sheet member on the tray and input of a feeding request. Therefore, the pickup means is placed into the pickup means when the user inputs a feeding request after checking, for example, whether a loaded sheet member is a desired sheet member or not and whether a sheet member is in a predetermined holding state on the tray or not, so that a sheet member can be rapidly and certainly taken out by the pickup means.

BRIEF DESCRIPTION OF THE DRAWINGS

Other and further objects, features, and advantages of the invention will be more explicit from the following detailed description taken with reference to the drawings wherein.

DETAILED DESCRIPTION OF THE PREFERRED EMBODIMENTS

Figure 1:
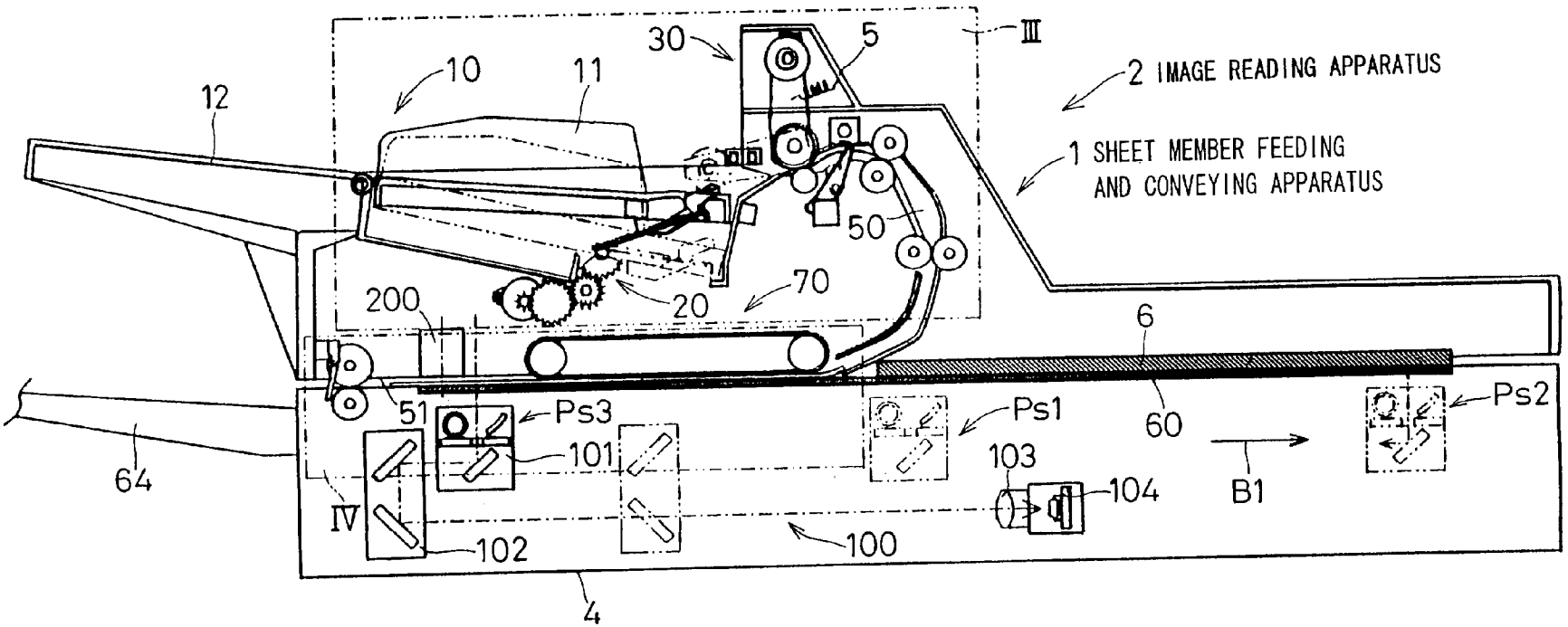
FIG. 1 is a sectional view showing an image reading apparatus equipped with a sheet member feeding and conveying apparatus of an embodiment of the invention.

Now referring to the drawings, preferred embodiments of the invention are described below.

Figure 2:
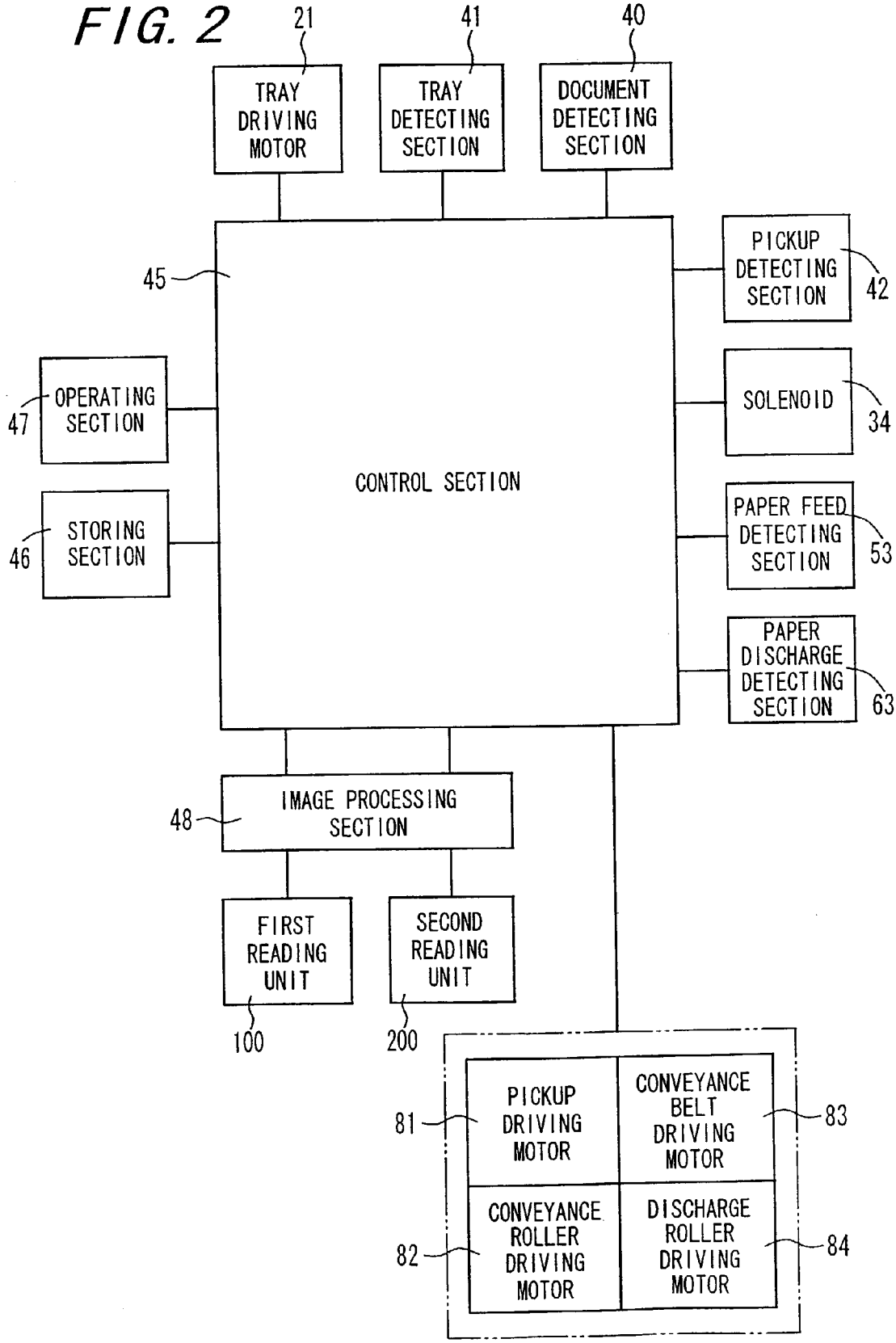
FIG. 2 is a block diagram showing an electrical configuration of the image reading apparatus.

FIG. 1 is a sectional view showing an image reading apparatus 2 equipped with a sheet member feeding and conveying apparatus 1 of an embodiment of the invention. FIG. 2 is a block diagram showing an electrical configuration of the image reading apparatus 2. In FIG. 1, thickness is partially omitted in order to make comprehension easy. The image reading apparatus 2 is an apparatus which optically reads an image formed on a document as a sheet member, converts to electric signals, and outputs as digital image data. The image reading apparatus 2, when located on a horizontal plane, is capable of reading images formed on both faces of a document by a first reading unit 100 which is supported by a lower case 4 placed below an upper case 5 by which the sheet member feeding and conveying apparatus 1 is supported and a second reading unit 200 which is supported by the upper case 5 supporting the sheet member feeding and conveying apparatus 1.

The sheet member feeding and conveying apparatus 1 comprises a tray 10, a tray driving section 20, a pickup section 30, a first conveying path 50, a second conveying path 51, and a belt conveying section 70. The tray driving section 20, the pickup section 30, the first conveying path 50, and the belt conveying section 70 are supported by the upper case 5.

Figure 3:
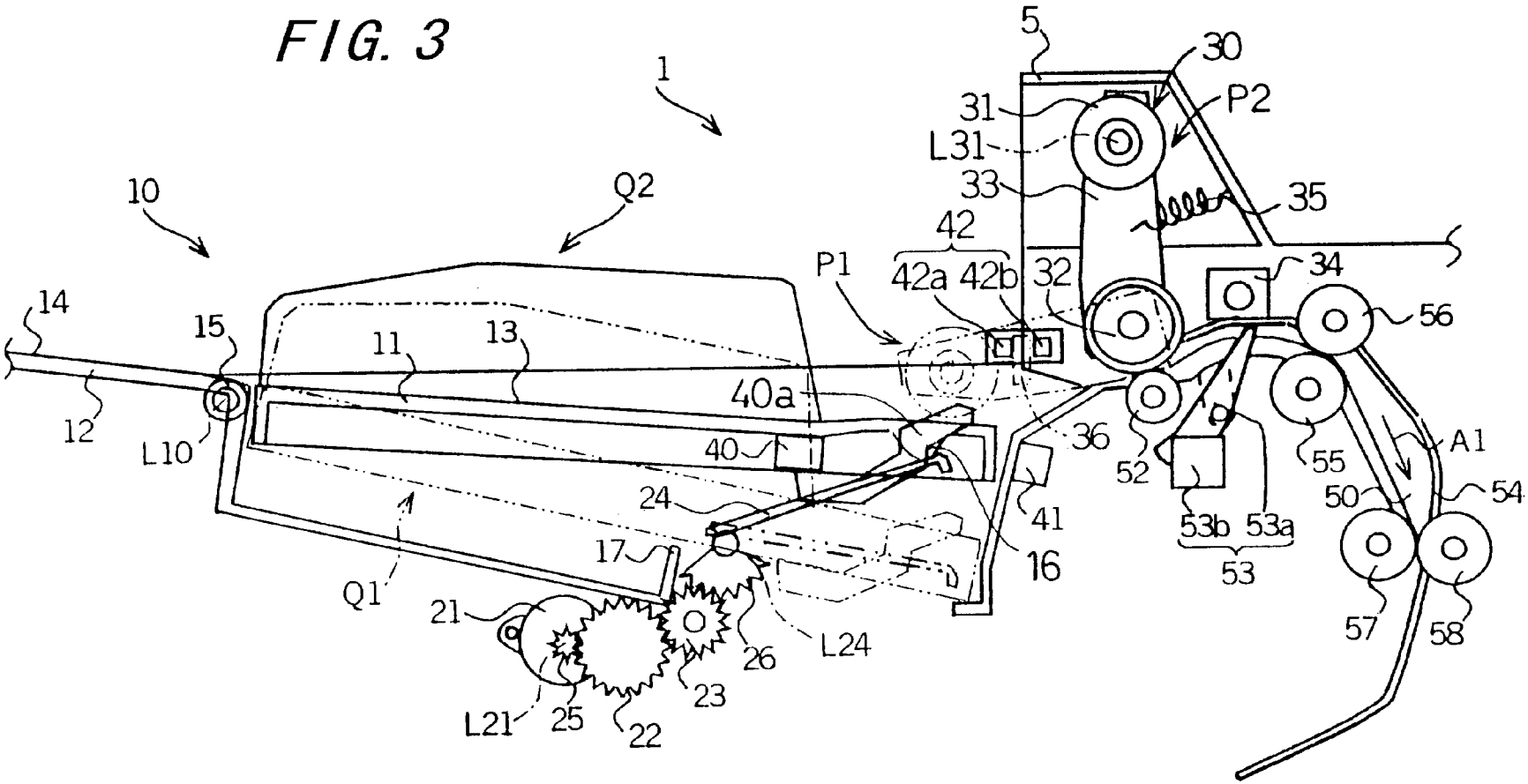
FIG. 3 is a sectional view showing a section III of FIG. 1 by enlarging.

FIG. 3 is a sectional view showing a section III of FIG. 1 by enlarging. In FIG. 3, thickness is partially omitted in order to make comprehension easy. The tray 10 includes a tray main body 11 and a fixed tray portion 12 that is fixed on the upper case 5. The tray main body 11 has a planate first holding face 13, and the fixed tray portion 12 has a planate second holding face 14. The first and second holding faces 13, 14 are placed so as to front upward when the image reading apparatus 2 is located on a horizontal plane. The tray main body 11 and the fixed tray portion 12 are connected to each other by a hinge portion 15 disposed to one end of the tray main body 11, so as to be capable of angular displacement about a tray axial line L10 stretched in parallel with the first and second holding faces 13, 14.

The tray main body 11 is provided with a document detecting section 40 serving as sheet member detecting means. The document detecting section 40 has, for example, an operation piece 40*a* which is capable of appearing from the other end of the first holding face 13 of the tray main body 11 and a sensor main body which switches between on and off states in response to an appearing motion of the operation piece 40*a*. The sensor main body may be realized by a photosensor. In a state where any external force does not act, the operation piece 40*a* protrudes more outwardly than the first holding face 13, and at this moment, the sensor main body is in the off state. When a document is loaded on the tray main body 11 at least, the operation piece 40*a* is pressed by the document to retreat from the first holding face 13 and evacuated, and the sensor main body is brought to the on state at this moment. The document detecting section 40 can detect the presence of a document on the tray main body 11 by the switch between the on and off states of the sensor main body, and when detecting that a document is held on the tray main body 11, gives a document detection signal which represents that a document is held, to a control section 45 described later.

The tray driving section 20 serving as tray driving means includes a tray driving motor 21, a first gear 22, a second gear 23, and a driving plate 24. The tray driving motor 21 is realized by a stepping motor, controlled when a pulse signal is given by the control section 45 serving as control means, and driven to rotate about a rotation driving axial line L21 stretched in parallel with the tray axial line L10. A pinion gear 25 is securely disposed to an output shaft of the tray driving motor 21, and rotates about the rotation driving axial line L21 together with the output shaft.

The first gear 22 is realized by, for example, a spur gear, supported so as to be rotatable about an axial line which is parallel with the rotation driving axial line L21, and meshed with the pinion gear 25. The second gear 23 is realized by, for example, a spur gear, supported so as to be rotatable about an axial line which is parallel with the rotation driving axial line L21, and meshed with the first gear 22. The driving plate 24 is substantially planate, and supported so as to be capable of angular displacement about a plate axial line L24 which is parallel with the rotation driving axial line L21 and which passes one end of the driving plate 24. To the one end of the driving plate 24, a gear piece 26 that makes angular displacement about the plate axial line L24 is disposed. The gear piece 26 is realized by, for example, a spur gear, and meshed with the second gear 23. Therefore, a rotation driving force outputted from the output shaft of the tray driving motor 21 is transmitted to the driving plate 24 via the first gear 23 and the second gear 24, and the driving plate 24 makes angular displacement about the plate axial line L24 by the rotation driving force.

The driving plate 24 is placed so that the other end of the driving plate 24 makes line contact with a rib 16 formed on the bottom portion of the tray main body 11 at all times. Thus, regarding the tray main body 11, the one end of the tray main body 11 is supported to the fixed tray portion 12 via the hinge portion 15, and the other end of the tray main body 11 is supported to the other end of the driving plate 24 via the rib. Therefore, when the driving plate 24 makes angular displacement about the plate axial line L24, the tray main body 11 makes angular displacement about the tray axial line L10.

Since the other end of the driving plate 24 and the rib 16 of the tray main body 11 are line contact with each other, it is possible to make a friction force due to contact smaller and cause the tray main body 11 to make angular displacement more smoothly than in the case of being face contact. Moreover, since the other end of the driving plate 24 and the rib 16 of the tray main body 11 are line contact with each other, it is possible to make local wear at a contact point less and make the durability of the tray main body 11 and the driving plate 24 higher than in the case of being point contact. Besides, by disposing the rib 16 that protrudes from the rear face of the first holding face 13, it is possible to increase the strength of the tray main body 11.

Below the tray main body 11 of the upper case 5, a convex portion 17 stretched in parallel with the tray axial line L10 and protruding toward the tray main body 11 is disposed. When the tray main body 11 is placed in a maximum amount holding position Q1, which is a position the farthest from the pickup section 30 described later, the tray main body 11 abuts on the convex portion 17. Since the tray main body 11 is placed in the maximum amount holding position Q1 when documents of the maximum holding amount of the tray 10 are held, when the tray main body 11 abuts on the convex portion 17, the tray main body 11 can thereby hold the maximum holding amount of documents in a stable manner at least. In this embodiment, the maximum amount of documents that can be held on the tray 10 is approximately 200 in a case where a document is 62 g/m$^2$ by basis weight.

The pickup section 30 serving as pickup means includes an attracting roller 31, a separation roller 32, and a connecting arm portion 33. The attracting roller 31 is a column-shaped roller whose peripheral portion is made of a resin such as rubber and whose axial line is an attracting roller axial line L31, and is supported by the connecting arm portion 33 so as to be rotatable about the attracting roller axial line L31 in a manner that the attracting roller axial line L31 and the tray axial line L10 are parallel with each other. The separation roller 32 is a column-shaped roller whose peripheral portion is made of a resin such as rubber and whose axial line is a separation roller axial line L32, and is supported by the connecting arm portion 33 so as to be rotatable about the separation roller axial line L32 in a manner that the separation roller axial line L32 and the tray axial line L10 are parallel with each other.

The attracting roller 31 rotates about the attracting roller axial line L31 when a rotation driving force outputted from an output shaft of a pickup driving motor 81 (refer to FIG. 2) realized by, for example, a stepping motor is transmitted thereto via a power transmission mechanism (not shown). The separation roller 32 rotates about the separation roller axial line L32 when a rotation driving force outputted from the output shaft of the pickup driving motor 81 is transmitted thereto via a power transmission mechanism (not shown) Moreover, the separation roller 32 is placed so as to front, from above, the most upstream portion in a first conveying direction A1 described later of the first conveying path 50. The connecting arm portion 33 is supported more upwardly than the tray main body 11 in the upper case 5 so as to be capable of angular displacement about the separation roller axial line L32. With respect to the pickup section 30, the tray main body 11 is capable of angular displacement in directions close to and away from the pickup section 30, and driven by the tray driving section 20 so as to make angular displacement in the directions close to and away from the pickup section 30.

Further, in a feeding state of feeding a document held on the tray 10 to the first conveying path 50, the pickup section 30 is capable of displacement between a pickup position P1 where the attracting roller 31 abuts on a document closest to the pickup section 30 placed in a take-out position and is capable of taking out documents abutting on the attracting roller 31 one by one and an evacuation position P2 evacuated from the pickup position P1, more specifically, evacuated more upwardly than the pickup position P1 and within the upper case 5. Since the pickup section 30 does not exist in a space region fronting the tray 10 from above when the pickup section 30 is placed in the evacuation position P2, the user can easily place and load documents from above the tray 10 when loading documents, especially, loading a lot of documents on the tray 10.

A solenoid 34 is disposed to the upper case 5 near the pickup section 30. Moreover, a coil spring 35 is disposed so as to connect the upper case 5 near the pickup section 30 and the connecting arm portion 33 of the pickup section 30. In a solenoid off state where an electric current is not passed through the solenoid 34, the coil spring 35 applies a spring force for stably placing the pickup section 30 in the evacuation position P2 to the pickup section 30. When brought into a solenoid on state by the passage of an electric current, the solenoid 34 gives the pickup section 30 a driving force for resisting the spring force of the coil spring 35 and stably placing the pickup section 30 in the pickup position P1. By such pickup driving means including the solenoid 34 and the coil spring 35, the pickup section 30 can make angular displacement about the separation roller axial line L32, between the pickup position P1 and the evacuation position P2.

A tray detecting section 41 is realized by, for example, a reflective photoelectric switch having a light emitting portion and a light receiving portion, and detects the position of the tray main body 11. The tray detecting section 41 is placed in a position where, when the tray main body 11 is placed in a waiting position which is a position where a document closest to the pickup section 30 held on the tray 10 is placed in the take-out position, light emitted from the light emitting portion of the tray detecting section 41 is reflected by the tray main body 11 and the reflected light enters the light receiving portion of the tray detecting section 41. The tray detecting section 41 is in an on state when light enters the light receiving portion of the tray detecting section 41, and in an off state when light does not enter the light receiving portion. Thus, the tray detecting section 41 is capable of detecting by the switch between on and off whether the tray main body 11 is placed in the waiting position or not, and gives the control section 45 a waiting position placement signal which represents that the tray main body 11 is placed in the waiting position.

In a waiting state of waiting for loading of documents on the tray 10, a waiting position closer to the pickup section 30 than a maximum amount holding position Q1, which is the position of the tray main body 11 at the time when the maximum holding amount of documents are held on the tray 10, is a waiting position Q2 at the time when a few copy sheets of 62 g/m$^2$ by basis weight are held in this embodiment. The tray detecting section 41 is set so as to be in the on state when the tray main body 11 is placed in the waiting position Q2 as described before. This is because the number of documents to be read that is set the most frequently is a few, and in response to the most frequently set amount of documents, the waiting position is set. Moreover, at this moment, the position of the tray main body 11 is slightly lower than a position closest to the pickup section 30. The tray detecting section 41 is attached to the upper case 5 by, for example, the user.

A pickup detection section 42 is realized by, for example, a transmissive photoelectric switch which has a light emitting portion 42*a* and a light receiving portion 42*b* and in which the light emitting portion 42*a* and the light receiving portion 42*b* are placed apart so as to front each other, and detects the position of the pickup section 30. When the pickup section 30 is placed in the pickup position P1, the pickup detecting section 42 is placed in a position where a protrusion piece 36 disposed to the connecting arm portion 33 of the pickup section 30 is placed between the light emitting portion 42*a* and the light receiving portion 42*b* of the pickup detecting section 42 and light emitted from the light emitting portion 42*a* is shut off by the protrusion piece 36 and does not enter the light receiving portion 42*b*. The pickup detecting section 42 is in an off state when light enters the light receiving portion 42*b* of the pickup detecting section 42, and in an on state when light does not enter the light receiving portion 42*b*. Thus, the pickup detecting section 42 is capable of detecting by the switch between on and off whether the pickup section 30 is placed in the pickup position P1 or not, and gives the control section 45 a pickup placement signal which represents that the pickup section 30 is placed in the pickup position P1.

As described above, the pickup position P1 is a position where the attracting roller 31 of the pickup section 30 abuts on a document closest to the pickup section 30 held on the tray 10 placed in the take-out position. Therefore, detection whether the pickup section 30 is placed in the pickup position P1 or not is equal to detection whether a document closest to the pickup section 30 held on the tray 10 is placed in the take-out position or not. Thus, it is possible to detect whether the pickup section 30 is placed in the pickup position P1 or not and whether a document closest to the pickup section 30 held on the tray 10 is placed in the take-out position or not by the use of the only one pickup detecting section 42, so that it is possible to simplify the constitution of the sheet member feeding and conveying apparatus 1 without the need for detecting means which independently detects whether a document closest to the pickup section 30 held on the tray 10 is placed in the take-out position or not.

On the first conveying path 50 and the second conveying path 51, a document taken out of the tray 10 by the pickup section 30 is conveyed. The first conveying path 50 is a curved conveying path where a document is reversed while being conveyed so that one face of the document conveyed in the first conveying direction A1 which fronts upward when the document is held on the tray 10 fronts downward when the document is discharged from the first conveying path 50. The upper case 5 is provided with a guide body 54 along the first conveying path 50.

A separation auxiliary roller 52 is disposed so as to front the most upstream portion in the first conveying direction A1 of the first conveying path 50. The separation auxiliary roller 52 is a column-shaped roller whose axial line is parallel with the separation roller axial line L32, and supported to the upper case 5 so as to abut on the separation roller 32. When a document taken out by the attracting roller 31 is caught between the separation roller 32 and the separation auxiliary roller 52, and the separation roller 32 rotates, the document is conveyed on the first conveying path 50 in the first conveying direction A1. Moreover, the separation auxiliary roller 52 is provided with a torque limiter for limiting rotation about the axial line thereof. As a result, in a case where a plurality of documents are taken out by the attracting roller 31, torque required for conveyance increases, whereby only the separation auxiliary roller 52 of the separation roller 32 and the separation auxiliary roller 52 stops rotating, and therefore, only a document touching the separation roller 32 in rotation is separated and conveyed on the first conveying path 50 in the first conveying direction A1.

On the downstream side in the first conveying direction A1 from the separation roller 32 and the separation auxiliary roller 52 on the first conveying path 50, a paper feed detecting section 53 is disposed so as to front the first conveying path 50. The paper feed detecting section 53 has, for example, an operation piece 53*a* which is capable of appearing from the guide body 54 onto the first conveying path 50 on the downstream side in the first conveying direction A1 from the separation roller 32 and the separation auxiliary roller 52, and a sensor main body 53*b* which switches between on and off states in response to an appearing motion of the operation piece 53*a*. The sensor main body 53*b* may be realized by a photosensor.

The operation piece 53*a* protrudes onto the first conveying path 50 more than the guide body 54 when any external force does not act thereon, and on this occasion, the sensor main body 53*b* is in the off state. When a document is conveyed to the downstream side in the first conveying direction A1 from the separation roller 32 and the separation auxiliary roller 52, the operation piece 53*a* is pressed by the document to retreat from the first conveying path 50 and evacuated more than the guide body 54, and on this occasion, the sensor main body 53*b* is brought into the on state. By the switch between the on and off states of the sensor main body 53*b*, the paper feed detecting section 53 is capable of detecting the presence of a document on the downstream side in the first conveying direction A1 from the separation roller 32 and the separation auxiliary roller 52 on the first conveying path 50. When detecting that a document exists on the downstream side in the first conveying direction A1 from the separation roller 32 and the separation auxiliary roller 52 on the first conveying path 50, the paper feed detecting section 53 gives the control section 45 described later a conveying path document detection signal which represents that a document exists on the downstream side in the first conveying direction A1 from the separation roller 32 and the separation auxiliary roller 52 on the first conveying path 50. The control section 45 can recognize the timing of conveying a document based on the conveying path document detection signal.

A first conveyance driving roller 55 and a first conveyance driven roller 56 are disposed so as to front the first conveying path 50 on the downstream side in the first conveying direction A1 from the paper feed detecting section 53, and furthermore, a second conveyance driving roller 57 and a second conveyance driven roller 58 are disposed so as to front the first conveying path 50 on the downstream side in the first conveying direction A1 from the first conveyance driving roller 55 and the first conveyance driven roller 56. The first conveyance driving roller 55, the first conveyance driven roller 56, the second conveyance driving roller 57, and the second conveyance driven roller 58 are column-shaped rollers whose axial lines are parallel with the separation roller axial line L32 and whose peripheral portions are made of a resin such as rubber, and supported by the upper case 5 so as to be rotatable about the axial lines thereof.

The first and second conveyance driving rollers 55, 57 rotate about the axial lines by a rotation driving force outputted from an output shaft of a conveying roller driving motor 82 (refer to FIG. 2) realized by a stepping motor, for example. The first conveyance driven roller 56 abuts on the first conveyance driving roller 55, and rotates driven by the rotation of the first conveyance driving roller 55. Moreover, the second conveyance driven roller 58 abuts on the second conveyance driving roller 57, and rotates driven by the rotation of the second conveyance driving roller 57. A document is caught between the first conveyance driving roller 55 and the first conveyance driven roller 56, and conveyed to the downstream side in the first conveying direction A1 by the rotation of the first conveyance driving roller 55. Moreover, a document is caught between the second conveyance driving roller 57 and the second conveyance driven roller 58, and conveyed to the downstream side in the first conveying direction A1 by the rotation of the second conveyance driving roller 57.

Figure 4:
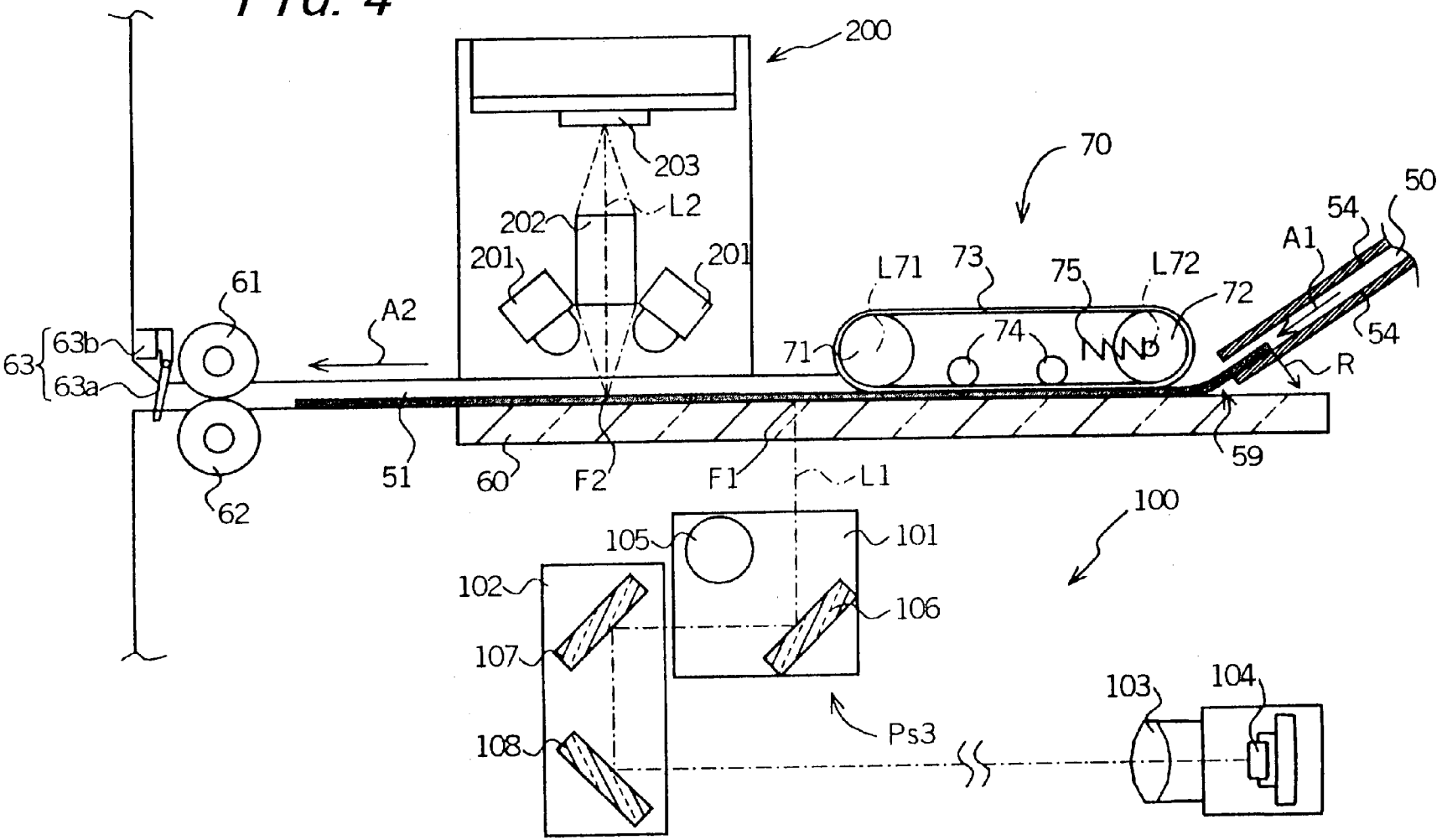
FIG. 4 is a sectional view showing a section IV of FIG. 1 by enlarging.

FIG. 4 is a sectional view showing a section IV of FIG. 1 by enlarging. In FIG. 4, thickness is partially omitted in order to make comprehension easy. The second conveying path 51 is a conveying path which is disposed so as to be connected to the most downstream portion in the first conveying direction A1 of the first conveying path 50 and stretched horizontally when the image reading apparatus 1 is placed on a horizontal plane. A light-transmitting platen glass 60 stretched in the horizontal direction so as to front the second conveying path 50 from below is supported to the lower case 4. The most downstream portion in the first conveying direction A1 of the first conveying path 50 is slanted with respect to the second conveying path 51, and an angle formed by the first conveying path 50 and the second conveying path 51 is set to 12 degrees, for example.

A belt conveying section 70 is disposed so as to front the upstream portion in the second conveying direction A2 of the second conveying path 51 from above. The belt conveying section 70 includes a driving roller 71, a driven roller 72, a belt 73, an auxiliary roller 74, and a spring member 75. The driving roller 71 is a column-shaped roller whose axial line is a driving roller axial line L71 stretched in parallel with the separation roller axial line L32 and at least whose peripheral portion is made of a resin such as polyacetal, supported by the upper case 5 so as to be rotatable about the driving roller axial line L31, and rotated about the driving roller axial line L31 by a rotation driving force outputted from an output shaft of a conveying belt driving motor 83 (refer to FIG. 2) realized by a stepping motor, for example.

The driven roller 72 is a column-shaped roller whose axial line is a driven roller axial line L72 stretched in parallel with the driving roller axial line L71, whose outer diameter is equal to the outer diameter of the driving roller 71 in size and at least whose peripheral portion is made of a resin such as polyacetal, and supported by the upper case 5 so as to be rotatable about the driven roller axial line L72. Moreover, a spring force is applied to the driven roller 72 in a direction away from the driving roller 71 by the spring member 75 realized by, for example, a coil spring. Furthermore, the driven roller 72 is placed on the upstream side in the second conveying direction A2 from the driving roller 71.

The belt 73 is realized by an endless belt made of, for example, urethane rubber, and wound around between the driving roller 71 and the driven roller 72. The thickness of the belt 73 is about 0.5 mm or more and 1.5 mm or less, for example. Since a spring force is given by the spring member 75 to the driven roller 72 in the direction away from the driving roller 71 as described before, a tensile force in the perimeter direction is generated on the belt 73. This tensile force generates, between the belt 73 and the driving roller 71 and between the belt 73 and the driven roller 72, resistance in the radial directions of the respective rollers 71, 72. Besides, since the resistance generates static friction forces between the belt 73 and the driving roller 71 and between the belt 73 and the driven roller 72, the belt 73 is moved between the driving roller 71 and the driven roller 72 by the rotation of the driving roller 71, and the driven roller 72 is rotated by the movement of the belt 73. In addition, because of the tensile force generated in the perimeter direction, portions of the belt 73 between the driving roller 71 and the driven roller 72 are tightly stretched like flat plates.

Further, since the driving roller 71 is placed on the downstream side in the second conveying direction A2 from the driven roller 72, the driving roller 71 rotates so as to pull the belt 73, a document makes face contact with a surface fronting the second conveying path 51 of a portion of the belt 73 pulled by a friction force generated between the belt 73 and the driving roller 71, and the document is conveyed in the second conveying direction A2 by the movement of the belt 73, it is possible to make a speed of conveying a document constant as compared with a case of conveying in a manner that a document makes face contact with a surface of a loosened portion of the belt 73.

The size of the outer diameter of the driving roller 71 is set in consideration of a friction force generated between the belt 73 and the driving roller. Moreover, the size of the outer diameter of the driven roller 72 is set in consideration of a contact state thereof with the belt 73, transmission of a rotation force from the belt 73, and so on. In this embodiment, the sizes of the outer diameters of the driving roller 71 and the driven roller 72 are set to about 25 mm, for example. For the purpose of increasing static friction forces between the belt 73 and the driving roller 71 and between the belt 73 and the driven roller 72, the outer peripheral faces of the driving roller 71 and the driven roller 72 may be coated with a polymeric material having a large friction coefficient.

On a face to become the rear side of a face fronting the second conveying path 51 of the belt 73 fronting the second conveying path 51, a plurality of (two in FIG. 4) auxiliary rollers 74 are supported while abutting. The auxiliary roller 74 is a column-shaped roller whose axial line is stretched in parallel with the driving roller axial line L71 and outer diameter is smaller in size than the outer diameters of the driving roller 71 and the driven roller 72. The auxiliary roller 74 is supported by the upper case 5 so as to be rotatable about the axial line. The number and interval in the alignment direction of the auxiliary rollers 74 are set depending on the interval between the driving roller 71 and the driven roller 72 so as not to be separated from at least the platen glass 60 when the belt 73 moves. The number of the auxiliary rollers 74 is, for example, a few to ten-odd, and the interval between the adjacent auxiliary rollers 74 is set to 50 to 120 mm, for example. The support by the auxiliary rollers 74 enables the face of the belt 73 fronting the second conveying path 51 between the driving roller 71 and the driven roller 72 to certainly keep a planate shape even when the belt 73 moves.

A document conveyed to the second conveying path 51 is caught between the belt 73 fronting the second conveying path 51 and the platen glass 60. A friction coefficient between the document and the belt 73 is sufficiently larger than a friction coefficient between the document and the platen glass 60. Therefore, the document certainly makes face contact with the belt 73 fronting the second conveying path 51 moved in the second conveying direction A2 by the rotation of the driving roller 71, and is conveyed to the downstream side in the second conveying direction A2 by a friction force between the document and the belt 73.

Since the most downstream portion in the first conveying direction A1 of the first conveying path 50 is slanted with respect to the second conveying path 51 as described before, a document is curved as shown in FIG. 4 when the document passes through a connection region 59 between the first conveying path 50 and the second conveying path 51. By the curvature of a document in the connection region 59, the document makes contact with the guide section 54 fronting the first conveying path 50, and gives resistance R in a direction perpendicular to the first conveying direction A1, more specifically, a direction heading outward in the curvature radial direction of the connection region 59. Because of a reaction force of the resistance R, a friction force in the opposite direction to the first conveying direction A1 is applied to the document. When the document is separated from the guide section 54 while the most upstream portion of the document in the first conveying direction A1 passes through the most downstream portion in the first conveying direction A1 in the first conveying direction A1 of the first conveying path 50, and a friction force between the document and the guide section 54 is lost, the magnitude of an external force acting on the document in a direction of conveying the document changes radically.

Since the driven roller 72 is placed on the upstream side in the second conveying direction A2 more than the driving roller 71 and given a spring force by the spring member 75 in the direction away from the driving roller 71 as described before, the spring member 75 can absorb a radical change of the external force acting on the document in the direction of conveying the document, that is, acting in the second conveying direction A2. Moreover, because of face contact between a document and the belt 73, a friction force is large as compared with that in a case where, for example, a document makes line contact with a cylindrical roller, so that it is possible to make a speed of conveying a document constant against a radical change of the external force acting on a document.

The interval between the driving roller axial line L71 of the driving roller 71 and the driven roller axial line L72 of the driven roller 72 is set so that the contact area of a document and the belt 73 becomes an area which enables obtaining a friction force against a change of the external force acting on a document.

The first reading unit 100 has a first reading position F1 on the downstream side in the second conveying direction A2 from the belt conveying section 70. The second reading unit 200 has a second reading position F2 on the downstream side in the second conveying direction A2 apart from the first reading position F1. The interval between the first reading position F1 and the second reading position F2 is 15 mm, for example.

A document mat 6 is disposed to the upper case 50 in a position fronting the platen glass 60 except the belt conveying section 70, the second reading unit 200, a discharge driving roller 62 and a paper discharge detecting section 63. The document mat 6 is a substantially planate mat which has elasticity at least in the thickness direction, and is capable of abutting on the platen glass 60 so as to make face contact.

The first reading unit 100 includes a first scanning portion 101, a second scanning portion 102, an imaging lens 103 and a charge coupled apparatus (abbreviated to CCD) 104, and is supported by the lower case 4 under the platen glass 60.

The first scanning portion 101 includes a light source 105 and a first reflection mirror 106. The light source 105 is realized by, for example, a halogen lamp, and irradiates a document existing on the second conveying path 51 with light via the platen glass 60. The first reflection mirror 106 reflects light emitted from the light source 105 and reflected on a document into a predetermined direction. In this embodiment, in a state where the image reading apparatus 2 is placed on a horizontal plane, a reflection face of the first reflection mirror 106 is placed at a slant of 45 degrees with respect to the horizontal plane so as to front upward in the vertical direction and front the horizontal direction, and reflects light from a document entering from above in the substantially vertical direction into the horizontal direction.

The second scanning portion 102 includes a second reflection mirror 107 and a third reflection mirror 108. The second reflection mirror 107 reflects light from the first reflection mirror 106 of the first scanning portion 101 toward the third reflection mirror 108. The third reflection mirror 108 is placed below the second reflection mirror 107, and reflects light from the second reflection mirror 107 into a predetermined direction. In this embodiment, a reflection face of the second reflection mirror 107 is placed at a slant of 45 degrees with respect to the horizontal plane so as to front the third reflection mirror 108 and the first reflection mirror 106, and reflects light from the first reflection mirror 106 entering in the substantially horizontal direction, downward in the vertical direction. Moreover, a reflection face of the third reflection mirror 108 is placed at a slant of 45 degrees with respect to the horizontal plane so as to front a direction parallel with a direction opposite to the second conveying direction A2, and reflects light from the second reflection mirror 107 entering from above in the substantially vertical direction, into a direction parallel with a direction opposite to the second conveying direction A2.

The imaging lens 103 is realized by, for example, a convex lens, and concentrates light from the third reflection mirror 108 of the second scanning portion 102 to the CCD 104. The CCD 104 converts light concentrated by the imaging lens 103 to analog electric signals by photoelectric conversion and outputs it. The imaging lens 103 and the CCD 104 are fixed to the lower case 4.

The first and second scanning portions 101, 102 are supported to the lower case 4 so as to be capable of displacement in the second conveying direction A2 along the platen glass 60. The first and second scanning portions 101, 102 are driven to be displaced in the second conveying direction A2 along the platen glass 60 by scanning portion driving means (not shown) including, for example, a stepping motor and a wire.

In a still reading mode of reading an image formed on a document in the state of keeping the document still in the image reading apparatus 2, a document is placed on the platen glass 60 fronting the document mat 6, and caught between the document mat 6 and the platen glass 60. At this moment, the first scanning portion 101 is placed in a first scanning position Ps1 fronting a portion closest to the belt conveying section 70 of the document mat 6.

When the user places a document so that a face desired to be read fronts the platen glass 60 fronting the document mat 6, and operates the operation section 47 to input a still document reading instruction which represents reading of a document in the still reading mode, the first reading unit 100 makes the light source 105 of the first scanning portion 101 emit light, and reads an image formed on the document while being displaced in a first scanning direction B1, which is a direction away from the belt conveying direction 70. The first scanning portion 101 is capable of displacement from the first scanning position Ps1 to a second scanning position Ps2 fronting a portion the farthest away from the belt conveying section 70 of the document mat 6. In order to make the length of an optical path from a document to the CCD 104 of the first reading unit 100 constant, the scanning portion driving means is controlled so that a second displacement speed U, which is a displacement speed of the second scanning portion 102 at the time of reading a document, has the same direction as a first displacement speed V, which is a displacement speed of the first scanning portion 101 at the time of reading a document, and so that the magnitude thereof is one half of that of the first displacement speed V (U=V/2).

After reading all images formed on a document, the first reading unit 100 turns off the light source 105, and is displaced in the opposite direction to the first scanning direction B1 and placed in the first scanning position Ps1. Such control of the first reading unit 100 is executed by the control section 45.

When the image reading apparatus 2 is not used, the first scanning portion 101 rests in a home position, which is one of the first scanning position Ps1, a third scanning position Ps3, and a middle position between the first scanning position Ps1 and the third scanning position Ps3.

The first reading unit 100 is capable of photoelectric conversion of light reflected on a document in an image pickup device, accumulation of the charges in the charge coupled device, and generation of an image based on the amount of the charges accumulated during a predetermined time. In this manner, by reading a document placed on the platen glass 60 and generating image data repeatedly at predetermined times, the first reading unit 100 can obtain a two-dimensional image identical to an image formed on a face fronting the first reading unit 100 of the document while displacing the first scanning portion 101 in the first scanning direction B1. Analog signals which represent generated image data are converted to digital signals in an image processing section 48, and given to the control section 45.

The second reading unit 200 is realized by a contact image sensor (abbreviated to CIS), and supported by the upper case 5 so as to front the second conveying path 51. The second reading unit 200 includes a light emitting portion 201, a light guiding portion 202 and an image sensor 203. The light emitting portion 201 is constituted in a manner that, for example, a plurality of light emitting diodes (abbreviated to LED) which emit light to a document to be conveyed in the second conveying direction A2 of the second conveying path 51 and read are placed in parallel in a direction parallel with the driving roller axial line L71 of the driving roller 71, that is, a direction perpendicular to the second conveying direction A2. The light guiding portion 202 is constituted by, for example, a lens array which concentrates light emitted from the light emitting portion 201 to a document and reflected in the second reading position F2, to the image sensor 203. The image sensor 203 includes the image pickup device having a plurality of light receiving elements aligned straightly and a charge coupled device, and receives light reflected on a document and perform photoelectric conversion of the received light.

The second reading unit 200 is capable of photoelectric conversion of light reflected on a document in the image pickup device, accumulation of the charges in the charge coupled device, and generation of an image based on the amount of the charges accumulated during a predetermined time. In this manner, by reading a document caught between the second reading unit and the platen glass 60, and generating image data repeatedly at predetermined times, the second reading unit 200 is capable of obtaining a two-dimensional image identical to an image formed on a face fronting the second reading unit 200 of a document conveyed in the second conveying direction A2. Analog signals which represent generated image data are converted to digital signals in the image processing section 48, and given to the control section 45.

A discharge driving roller 61 and a discharge driven roller 62 are disposed so as to front the second conveying path 51 on the downstream side in the second conveying direction A2 from the second reading unit 200. The discharge driving roller 61 and the discharge driven roller 62 are column-shaped rollers whose axial lines are stretched in parallel with the attracting roller axial line L31 and whose peripheral portions are made of a resin such as rubber. The discharge driving roller 61 is supported by the upper case 5 so as to be rotatable about the axial line thereof. The discharge driven roller 62 is supported by the lower case 4 so as to be rotatable about the axial line thereof.

The discharge driving roller 61 is rotated about the axial line by a rotation driving force outputted from an output shaft of a discharge roller driving motor 84 (refer to FIG. 2) realized by, for example, a stepping motor. The discharge driven roller 62 abuts on the discharge driving roller 61, and rotates driven by the rotation of the discharge driving roller 61. A document read by the first and second reading units 100, 200 is caught between the discharge driving roller 61 and the discharge driven roller 62, and conveyed to the downstream side in the second conveying direction A2 by the rotation of the discharge driving roller 61.

A paper discharge detecting section 63 is disposed so as to front the most downstream portion in the second conveying direction A2 of the second conveying path 51, which is on the downstream side in the second conveying direction A2 from the discharge driving roller 61 and the discharge driven roller 62. The paper discharge detecting section 63 has, for example, an operation piece 63*a* capable of appearing on the most downstream portion in the second conveying direction A2 of the second conveying path 51 and a sensor main body 63*b* which switches between on and off states in response to the appearing motion of the operation piece 63*a*. The sensor main body 63*b* may be realized by a photosensor.

In a state where any external force does not act, the operation piece 63*a* protrudes to the second conveying path 51, and on this occasion, the sensor main body 63*b* is in the off state. When a document is conveyed to the most downstream portion in the second conveying direction A2 of the second conveying path 51 by the discharge driving roller 61 and the discharge driven roller 62, the operation piece 63*a* is pressed by the document to retreat from the second conveying path 51 and evacuated, and on this occasion, the sensor main body 63*b* is brought into the on state. By the switch between the on and off states of the sensor main body 63*b*, the paper discharge detecting section 63 can detect that a document is flown down through the most downstream portion in the second conveying direction A2 of the second conveying path 51 and discharged to a paper discharge tray 64, and when detecting that the document is discharged to the paper discharge tray 64, gives the control section 45 described later a paper discharge detection signal which represents that the document is discharged to the paper discharge tray 64. A document passed through the paper discharge detecting section 63 is discharged to the paper discharge tray 64.

The upper case 5 and the lower case 4 are connected by, for example, a hinge so that the upper case 5 is capable of angular displacement with respect to the lower case 4 and the document mat 6 and the belt conveying section 70 of the upper case 5 and the platen glass 60 of the lower case 4 are capable of being close to and away from each other.

The image reading apparatus 2 further comprises the control section 45, a storing section 46, the operating section 47, and the image processing section 48. The control section 45 is realized by, for example, a processor such as a central processing unit (abbreviated to CPU), and controls at least the tray driving motor 21, the solenoid 34, the pickup driving motor 81, the conveying roller driving motor 82, the conveying belt driving motor 83, the discharge roller driving motor 84, the first reading unit 100, and the second reading unit 200, thereby totally controlling the image reading apparatus 2.

The storing section 46 is realized by, for example, a volatile memory such as a random access memory (abbreviated to RAM), a nonvolatile memory such as a read only memory (abbreviated to ROM), and a large-capacity magnetic storing medium such as a hard disk drive (abbreviated to HDD). In the storing section 46, a program for controlling the image reading apparatus 2 which the control section can execute is previously stored. Moreover, in the storing section 46, image data of an image formed on a document read by the first and second reading units 100, 200 is temporarily stored. Furthermore, in the storing section 46, various kinds of set data such as a waiting position, loading completion waiting time and request waiting time which are inputted from the operating section 47 are stored.

The operating section 47 that serves as waiting position inputting means, loading completion waiting time inputting means, take-out request inputting means, request waiting time inputting means and feeding request inputting means is realized by, for example, an inputting apparatus such as a keyboard and a touch panel and a display apparatus such as a liquid crystal display apparatus. The user of the image reading apparatus 2 can input a waiting position, loading completion waiting time, request waiting time, a still document reading instruction, a running document reading instruction, a both-face document reading instruction and the like by operating the operating section 47 to input. In this embodiment, a take-out request includes a still document reading instruction, a running document reading instruction and a both-face document reading instruction.

The image processing section 48 includes an analog/digital converter and a processor, for example. The image processing section 48 converts analog signals which represent image data from the first and second reading units 100, 200 into digital signals, applies various kinds of image processing to digitalized image data, and gives to the control section 45.

In the image reading apparatus 2, in a running reading mode of loading a document on the tray 10, conveying the document on the first and second conveying paths 50, 51 and reading an image formed on a face fronting the platen glass 60 of the document on the second conveying path 51, and in a both-face reading mode of loading a document on the tray 10, conveying the document on the first and second conveying paths 50, 51 and reading images formed on both faces of the document, the first scanning portion 101 of the first reading unit 100 is placed in the third scanning position Ps3 fronting the first reading position F1.

When the user loads a document on the tray 10 so that a face desired to be read (may be referred to as "an image forming face" hereafter) fronts above, and operates the operating section 47 to input a running document reading instruction which represents reading of a document in the running reading mode, the control section 45 controls the first reading unit 100 based on the running document reading instruction to place the first scanning portion 101 in the third scanning position Ps3. Subsequently, in accordance with procedures shown in FIGS. 5, 7 described later, the control section 45 controls the tray driving section 20 and the pickup section 30 to take out the document from the tray 10.

Subsequently, the control section 45 controls the conveying roller driving motor 82 to rotate the first and second conveyance driving rollers 55, 57 based on a conveying path document detection signal from the paper feed detecting section 53 and convey the document taken out of the tray 10 so as to flow down on the first conveying path 50 in the first conveying direction A1. At this moment, the document is reversed by being conveyed on the first conveying path 50, and on the second conveying path 51, the image forming face fronts below, that is, the platen glass 60. Subsequently, the control section 45 controls the conveying belt driving motor 83 to rotate the driving roller 71 of the belt conveying section 70, move the belt 73 in the second conveying direction A2 and convey the document so as to flow down on the second conveying path 51 in the second conveying direction A2. At this moment, the document passes through the first reading position F1. After that, the control section 45 controls the discharge roller driving motor 82 to rotate the discharge driving roller 61 and discharge the document to the paper discharge tray 64.

Further, when the document passes through the first reading position F1, the control section 45 controls the first reading unit 100 to cause the light source 105 of the first scanning portion 101 to emit light and irradiate the image forming face of the document passing through the first reading position F1 with the light. Reflection light from the document enters the CCD 104 via the respective reflection mirrors 106 to 108 of the first scanning portion 101 and the second scanning portion 102 and the imaging lens 103. Thus, the first reading unit 100 reads an image formed on an image forming face of a document.

Further, when the user loads a document on the tray 10 and operates the operating section 47 to input a both-face document reading instruction which represents reading of a document in the both-face reading mode, the control section 45 controls the first reading unit 100 to place the first scanning portion 101 in the third scanning position Ps3 based on the both-face document reading instruction. Subsequently, the control section 45 controls the tray driving section 20 and the pickup section 30 to take a document out of the tray 10 in accordance with the procedures shown in the flowcharts of FIGS. 5, 7.

Subsequently, based on a conveying path document detection signal from the paper feed detecting section 53, the control section 45 controls the conveying roller driving motor 82 to rotate the first and second conveyance driving rollers 55, 57 and convey the document taken out of the tray 10 so as to flow down in the first conveying direction A1 on the first conveying path 50. At this moment, the document is reversed by being conveyed on the first conveying path 50, and on the second conveying path 51, a face fronting above when the document is held on the tray 10 (may be referred to as "a first face" hereafter) fronts below, that is, the platen glass 60 and a face fronting below when the document is held on the tray 10 (may be referred to as "a second face" hereafter) fronts above, that is, the belt conveying section 70. Subsequently, the control section 45 controls the conveying belt driving motor 83 to rotate the driving roller 71 of the belt conveying section 70, move the belt 73 in the second conveying direction A2 and convey the document so as to flow down in the second conveying direction A2 on the second conveying path 51. At this moment, the document passes through the first reading position F1 and the second reading position F2. After that, the control section 45 controls the discharge roller driving motor 82 to rotate the discharge driving roller 61 and discharge the document to the paper discharge tray 64.

Further, when the document passes through the first reading position F1, the control section 45 controls the first reading unit 100 to cause the light source 105 of the first scanning portion 101 to emit light and irradiate the first face of the document passing through the first reading position F1 with the light. Reflection light from the document enters the CCD 104 via the respective reflection mirrors 106 to 108 of the first scanning portion 101 and the second scanning portion 102 and the imaging lens 103. Thus, the first reading unit 100 reads an image formed on a first face of a document.

Further, when the document passes through the second reading position F2, the control section 45 controls the second reading unit 200 to cause the light emitting portion 201 to emit light and irradiate the second face of the document passing through the second reading position F2 with the light. Reflection light from the document enters the image sensor 203 via the light guiding portion 202. Thus, the second reading unit 200 reads an image formed on a second face of a document. In this manner, in the both-face reading mode, it is possible by conveying the document on the first and second conveying paths 50, 51 only once to read images formed on both faces of a document by the use of the first reading unit 100 and the second reading unit 200.

Since the first reading position F1 of the first reading unit 100 and the second reading position F2 of the second reading unit 200 locate a predetermined interval apart, it is possible to space an optical axis L1 of reflection light from a first face of a document in the first reading position F1 and an optical axis L2 of reflection light from a second face of a document in the second reading position F2. As a result, it is possible to prevent that light emitted from the light source 105 of the first scanning portion 101 of the first reading unit 100 and passed through a document enters the image sensor 203 of the second reading unit 200 and the second reading unit 200 reads an image formed on a first face of a document, and that light emitted from the light emitting portion 202 of the second reading unit 200 and passed through a document enters the CCD 104 of the first reading unit 100 and the first reading unit 100 reads an image formed on a second face of a document, and it is possible to accurately read images formed on a first face and a second face of a document.

Figure 5:
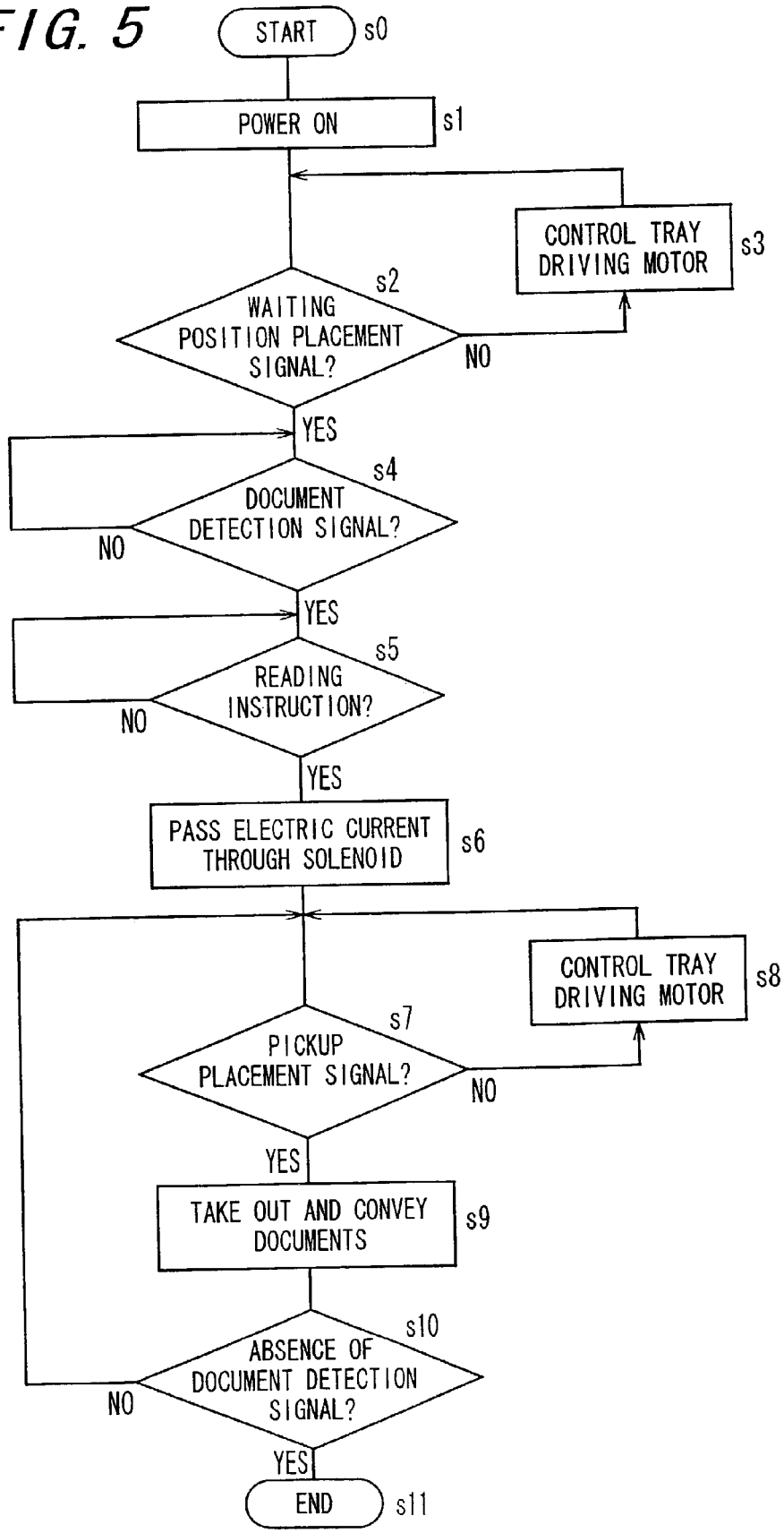
FIG. 5 is a flowchart showing a first procedure of controlling a tray and a pickup section in a running reading mode and a both-face reading mode of the image reading apparatus.

FIG. 5 is a flowchart showing a first procedure of controlling the tray 10 and the pickup section 30 in the running reading mode and the both-face reading mode of the image reading apparatus 2. FIGS. 6A to 6D are sectional views schematically showing motions of the tray main body 11 and the pickup section 30. The first control procedure starts at step s0, and goes to step s1. At step s1, when the user of the image reading apparatus 2 performs an input operation of the operating section 47, power is applied to the image reading apparatus 2, and the procedure goes to step s2. At step s2, the control section 45 determines whether a waiting position placement signal from the tray detecting section 41 exists or not, and the procedure goes to step s3 when it is determined that a waiting position placement signal does not exist, whereas the procedure goes to step s4 when it is determined that a waiting position placement signal exists.

Figure 6A:
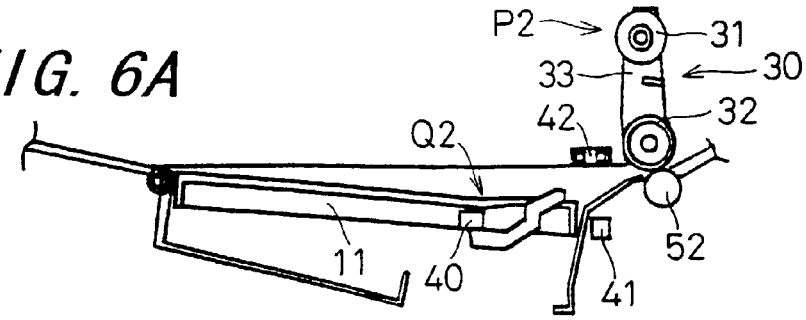
FIGS. 6A to 6D are sectional views schematically showing the operation of a tray main body and the pickup section.

When it is determined at step s2 that a waiting position placement signal does not exist, that is, the tray main body 11 is not placed in the waiting position Q2, and the procedure goes to step s3, the control section 45 controls the tray driving motor 21 to cause the tray main body 11 to make angular displacement at step s3, and the procedure goes back to step s2. The tray driving motor 21 is controlled based on a waiting position placement signal from the tray detecting section 41, and by repeatedly executing step s1 and step s2, the tray main body 11 is placed in the waiting position Q2, and the tray main body 11 is kept still in the waiting position Q2 until the procedure goes to step s8 described later. Moreover, until the procedure goes to step s6 described later, the control section 45 does not pass an electric current through the solenoid 34, and the pickup section 30 is placed in the evacuation position P2 as shown in FIG. 6A. Therefore, until the procedure goes to step s6, the user can easily load a document on the tray 10 and easily remove a document held on the tray 10.

When it is determined at step s2 that a waiting position placement signal exists, that is, the tray main body 11 is placed in the waiting position Q2 as shown in FIG. 6A, and the procedure goes to step s4, the control section 45 determines at step s4 whether a document detection signal from the document detecting section 40 exists or not, and the procedure goes to step s5 when it is determined that a document detection signal exists. Determination of the presence of a document detection signal at step s4 is continued until it is determined that a document detection signal exists.

When it is determined at step s4 that a document detection signal exists, that is, a document is loaded and held on the tray 10, and the procedure goes to step s5, the control section 45 determines at step s5 whether either a running document reading instruction or a both-face document reading instruction (these instructions may be referred to as "reading instructions" hereafter) is inputted from the operating section 47, and the procedure goes to step s6 when it is determined that a reading instruction is inputted. Determination at step s5 whether a reading instruction is inputted or not is continued until it is determined that a reading instruction is inputted.

Figure 6B:
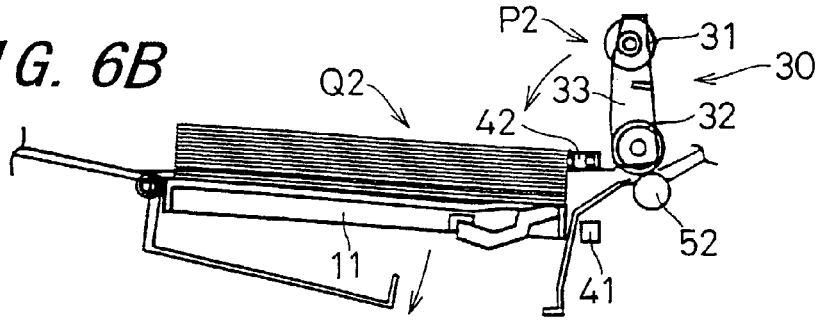

When it is determined at step s5 that a reading instruction is inputted, and the procedure goes to step s6, the control section 45 passes an electric current through the solenoid 34 and causes the attracting roller 31 of the pickup section 30 to abut on a document held on the tray 10 as shown in FIG. 6B at step s6, and the procedure goes to step s7.

At step s7, the control section 45 determines whether a pickup placement signal from the pickup detecting section 42 exists or not, and the procedure goes to step s8 when it is determined that a pickup placement signal does not exist, whereas the procedure goes to step s9 when it is determined that a pickup placement signal exists.

Figure 6C:
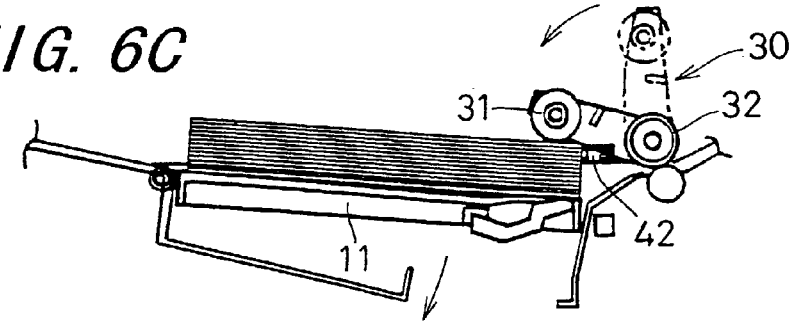

When it is determined at step s7 that a pickup placement signal does not exist, that is, the pickup section 30 is not placed in the pickup position P1 as shown in FIG. 6C, and the procedure goes to step s8, the control section 45 controls the tray driving motor 21 to cause the tray main body 11 to make angular displacement at step s8, and the procedure goes back to step s7. Control of the tray driving motor 21 is executed based on a pickup placement signal from the pickup detecting section 42, and by repeatedly executing step s7 and step s8, the pickup section 30 is placed in the pickup position P1.

Figure 6D:
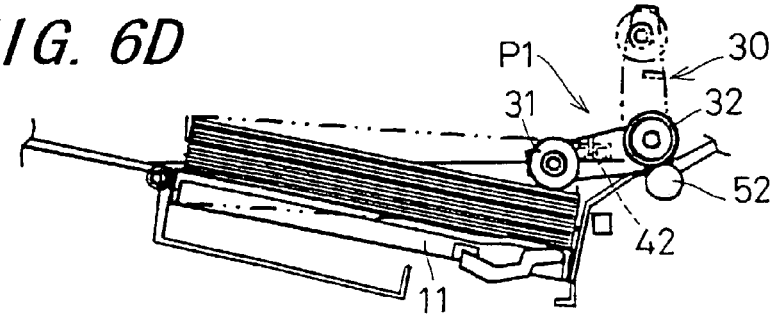

When it is determined at step s7 that a pickup placement signal exists, that is, the pickup section 30 is placed in the pickup position P1 as shown in FIG. 6D, and the procedure goes to step s9, the control section 45 controls the pickup driving motor 81 and the conveyance roller driving motor 82 to take out documents held on the tray 10 one by one sequentially from a document closest to the pickup section 30 placed in the take-out position and convey to the first conveying path 50 at step s9, and the procedure goes to step s10.

At step s10, the control section 45 determines whether a document detection signal from the document detecting section 40 exists or not, and the procedure goes back to step s7 when a document detection signal exists, whereas when it is determined that a document detection signal does not exist, that is, all the documents are taken out of the tray 10 and the tray 10 does not hold any document, the procedure goes to step s11, and the control section 45 controls the tray driving section 20 to place the tray main body 11 in the waiting position Q2, and all the procedural steps end.

Figure 7:
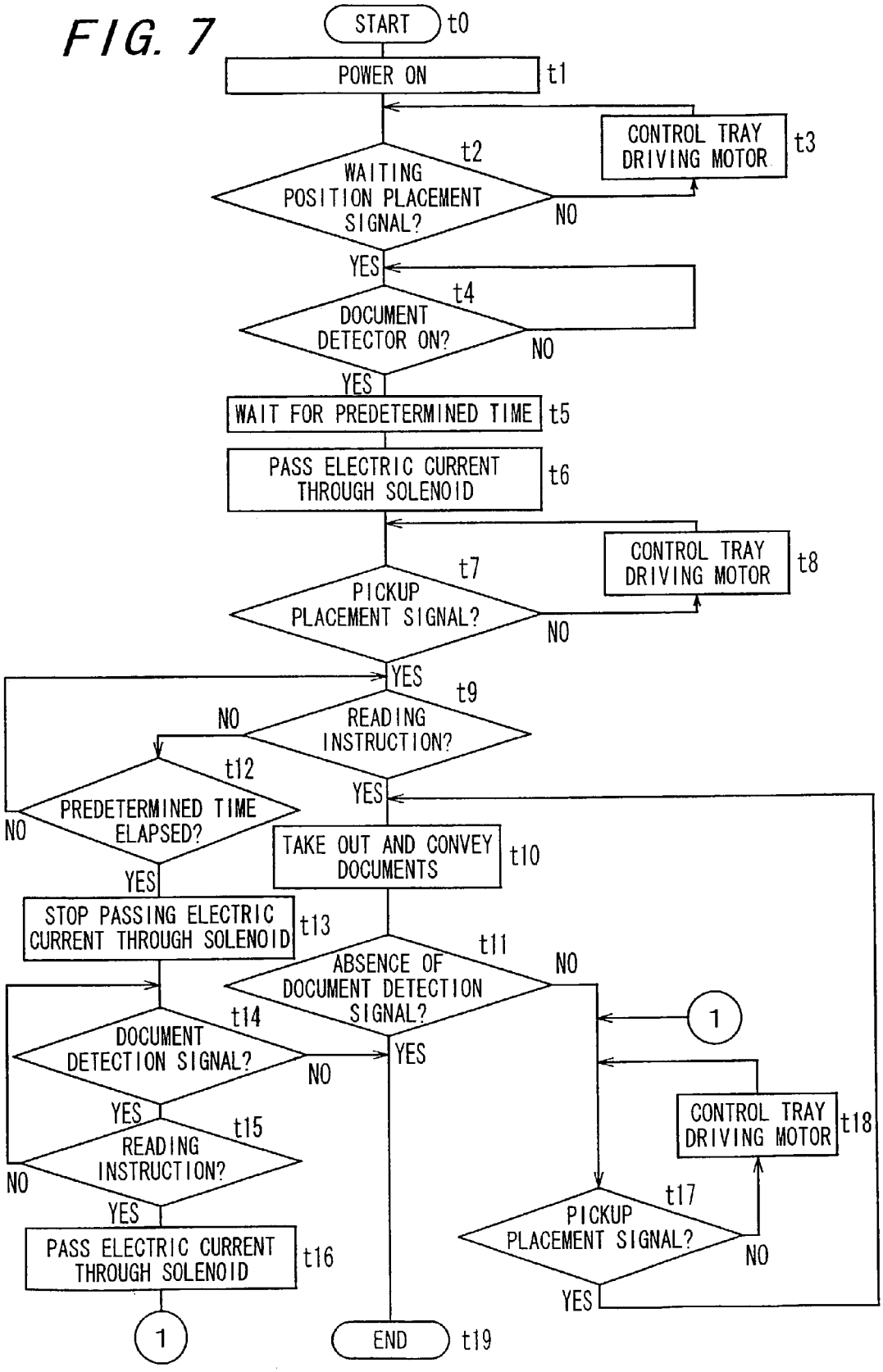
FIG. 7 is a flowchart showing a second procedure of controlling the tray and the pickup section in the running reading mode and the both-face reading mode of the image reading apparatus.

FIG. 7 is a flowchart showing a second procedure of controlling the tray 10 and the pickup section 30 in the running reading mode and the both-face reading mode of the image reading apparatus 2. Here, FIG. 6 will be also referred to. The second control procedure starts at step t0, and the procedure goes to step t1.

At step t1, when the user of the image reading apparatus 2 performs an input operation of the operating section 47, power is applied to the image reading apparatus 2, and the procedure goes to step t2. At step t2, the control section 45 determines whether a waiting position placement signal from the tray detecting section 41 exists or not, and the procedure goes to step t3 when it is determined that a waiting position placement signal does not exist, whereas the procedure goes to step t4 when it is determined that a waiting position placement signal exists.

When it is determined at step t2 that a waiting position placement signal does not exist, that is, the tray main body 11 is not placed in the waiting position Q2, and the procedure goes to step t3, the control section 45 controls the tray driving motor 21 to cause the tray main body 11 to make angular displacement at step s3, and the procedure goes back to step t2. The tray driving motor 21 is controlled based on a waiting position placement signal from the tray detecting section 41, and by repeatedly executing step t1 and step t2, the tray main body 11 is placed in the waiting position Q2, and the tray main body 11 is kept still in the waiting position Q2 until the procedure goes to step t8 described later. Moreover, until the procedure goes to step t6 described later, the control section 45 does not pass an electric current through the solenoid 34, and the pickup section 30 is placed in the evacuation position P2 as shown in FIG. 6A. Therefore, until the procedure goes to step t6, the user can easily load a document on the tray 10 and easily remove a document held on the tray 10.

When it is determined at step t2 that a waiting position placement signal exists, that is, the tray main body 11 is placed in the waiting position Q2 as shown in FIG. 6A, and the procedure goes to step t4, the control section 45 determines at step t4 whether a document detection signal from the document detecting section 40 exists or not, and the procedure goes to step t5 when it is determined that a document detection signal exists. Determination of the presence of a document detection signal at step t4 is continued until it is determined that a document detection signal exists.

When it is determined at step t4 that a document detection signal exists, that is, a document is loaded and held on the tray 10, and the procedure goes to step t5, the control section 45 waits for loading completion waiting time at step t5, which is for waiting for loading of documents and completion of loading and which is preset and stored in the storing section 46, and the procedure goes to step t6.

At step t6, as shown in FIG. 6B, the control section 45 passes an electric current through the solenoid 34 so as to place the pickup section 30 placed in the evacuation position P2 into the pickup section P1, and causes the attracting roller 31 of the pickup section 30 to abut on a document held on the tray 10, and the procedure goes to step t7. At step t7, the control section 45 determines whether a pickup placement signal from the pickup detecting section 42 exists or not, and the procedure goes to step t8 when it is determined that a pickup placement signal does not exist, whereas the procedure goes to step t9 when it is determined that a pickup placement signal exists.

When it is determined at step t7 that a pickup placement signal does not exist, that is, the pickup section 30 is not placed in the pickup position P1 as shown in FIG. 6C, and the procedure goes to step t8, the control section 45 controls the tray driving motor 21 to cause the tray main body 11 to make angular displacement at step t8, and the procedure goes back to step t7. The tray driving motor 21 is controlled based on a pickup placement signal from the pickup detecting section 42, and step s7 and step s8 are repeatedly executed so as to place the pickup section 30 in the pickup position P1.

When it is determined at step t7 that a pickup placement signal exists, that is, the pickup section 30 is placed in the pickup position P1 as shown in FIG. 6D, and the procedure goes to step t9, the control section 45 determines at step t9 whether a reading instruction is inputted from the operating section 47 or not, and the procedure goes to step t10 when it is determined that a reading instruction is inputted, whereas the procedure goes to step t12 when it is determined that a reading instruction is not inputted.

When it is determined at step t9 that a reading instruction is inputted from the operating section 47, and the procedure goes to step t10, the control section 45 controls the pickup driving motor 81 and the conveyance roller driving motor 82 to take out documents held on the tray 10 one by one sequentially from a document closest to the pickup section 30 placed in the take-out position and convey to the first conveying path 50 at step t10, and the procedure goes to step t11.

At step t11, the control section 45 determines whether a document detection signal from the document detecting section 40 exists or not, and the procedure goes to step t17 when it is determined that a document detection signal exists, whereas the procedure goes to step t19 when it is determined that a document detection signal does not exist, that is, all the documents are taken out of the tray 10 and the tray 10 does not hold any document, and the control section 45 controls the tray driving section 20 to place the tray main body 11 in the waiting position Q2, and all the procedural steps end.

When it is determined at step t9 that either the running document reading instruction or the both-face document reading instruction is not inputted from the operating section 47, and the procedure goes to step t12, the control section 45 determines at step t12 whether request waiting time, which is for waiting for input of either the running document reading instruction or the both-face document reading instruction and which is preset and stored in the storing section 46, is elapsed from passing of an electric current through the solenoid 34, and the procedure goes to step t13 when it is determined that the request waiting time is elapsed, whereas the procedure goes back to step t9 when it is determined that the request waiting time is not elapsed.

When it is determined at step t12 that the request waiting time is elapsed from passing of an electric current through the solenoid 34, and the procedure goes to step t13, the control section 45 stops passing an electric current through the solenoid 34 and places the pickup section 30 in the evacuation position P2 at step t13, and the procedure goes to step t14.

At step t14, it is determined whether a document detection signal from the document detecting section 40 exists or not, and the procedure goes to step t15 when it is determined that a document detection signal exists, whereas when it is determined that a document detection signal does not exist, that is, any document is not held on the tray 10, the procedure goes to step t19, and the control section 45 controls the tray driving section 20 to place the tray main body 11 in the waiting position Q2, and all the procedural steps end.

At step t15, the control section 45 determines whether a reading instruction is inputted from the operating section 47 or not, and the procedure goes to step t16 when it is determined that a reading instruction is inputted, whereas the procedure goes back to step t14 when it is determined that a reading instruction is not inputted.

When it is determined at step t15 that a reading instruction is inputted from the operating section 47, and the procedure goes to step t16, as shown in FIG. 6B, the control section 45 passes an electric current through the solenoid 34, and causes the attracting roller 31 of the pickup section 30 to abut on a document held on the tray 10 at step t16, and the procedure goes to step t17.

At step t17, the control section 45 determines whether a pickup placement signal from the pickup detecting section 42 exists or not, and the procedure goes back to step t10 when it is determined that a pickup placement signal exists, whereas the procedure goes to step t18 when it is determined that a pickup placement signal does not exist.

When it is determined at step t17 that a pickup placement signal does not exist, that is, the pickup section 30 is not placed in the pickup position P1 as shown in FIG. 6C, and the procedure goes to step t18, the control section 45 controls the tray driving motor 21 to cause the tray main body 11 to make angular displacement at step t18, and the procedure goes back to step t17. The tray driving motor 21 is controlled based on a pickup placement signal from the pickup detecting section 42, and step t17 and step t18 are repeatedly executed so as to place the pickup section 30 in the pickup position P1.

The loading completion waiting time is preset time for waiting for the user to load a document on the tray 10 and complete loading, and inputted from the operating section 47 and stored in the storing section 46. As shown by steps t4 to t6 of FIG. 7, in a waiting state, when it is determined by the document detecting section 40 that a document is loaded on the tray 10, the control section 45 passes an electric current through the solenoid 34 after a lapse of the loading completion waiting time so as to place the pickup section 30 placed in the evacuation position P2 into the pickup position P1.

The loading completion waiting time can be freely set depending on the level of skill of the user to loading of a document onto the tray 10. Moreover, the loading completion waiting time may be, for example, set for every user or set longer or shorter depending on a reading process, and selected by the user by an input operation of the operating section 47 at the time of using the image reading apparatus 2. The loading completion waiting time is set to approximately 1 to 8 seconds, for example. By setting the loading completion waiting time, it is possible, before documents are loaded on the tray 10 and the attracting roller 31 of the pickup section 30 abuts on the documents held on the tray 10, for example, to make an opportunity of adjusting the orientations of the documents held on the tray 10 and loading more documents on the tray 10. Thus, it is possible to prevent a conveyance failure called a jam of documents in the first conveying path 50 resulting from a holding state failure of documents on the tray 10, and easily load a lot of documents on the tray 10.

The request waiting time is preset time for waiting for the user to input either the running document reading instruction or the both-face document reading instruction, and inputted from the operating section 47 and stored in the storing section 46. As shown by steps t9 and t12 of FIG. 7, in a case where, after the pickup section 30 is displaced from the evacuation position P2 to the pickup position P1 and the attracting roller 31 abuts on a document, any reading instruction is not inputted after a lapse of the request waiting time, the control section 45 stops passing an electric current through the solenoid 34 so as to displace the pickup section 30 into the evacuation position P2.

The request waiting time can be freely set at a request of the user. Moreover, the request waiting time may be, for example, set and stored for every user or set longer or shorter depending on a reading process, and selected by the user by an input operation of the operating section 47 at the time of using the image reading apparatus 2. The request waiting time is set to approximately 10 to 30 seconds, for example. As a result of setting the request waiting time, it can be thought that documents to be read are added or reading of documents is cancelled in a case where any reading instruction is not inputted after a lapse of the request waiting time after the attracting roller 31 of the pickup section 30 abuts on documents held on the tray 10. Therefore, in this case, passing of an electric current through the solenoid 34 is stopped and the pickup section 30 is placed in the evacuation position P2, whereby the user can easily load documents on the tray 10 and easily remove documents from the tray 10.

As described above, according to the sheet member feeding and conveying apparatus 1 of this embodiment, by the tray driving section 20 controlled by the control section 45, the tray main body 11 is, in the waiting state of waiting for loading of documents on the tray 10, driven to be displaced in the waiting position Q2 that is closer to the pickup section 30 than the position Q1 at the time when the maximum holding amount of document are held on the tray 10, and in the feeding state of feeding documents held on the tray 10, driven to be displaced so that a document closest to the pickup section 30 held on the tray 10 is placed in the take-out position.

Since the amount of displacement from the waiting position Q2 closer to the pickup section 30 than the position Q1 at the time when the maximum holding amount of documents are held on the tray 10 to a position where a document closest to the pickup section 30 held on the tray 10 is placed in the take-out position is smaller than the amount of displacement from the waiting position Q1 at the time when the maximum holding amount of documents are held on the tray 10 to a position where a document closest to the pickup section 30 held on the tray 10 is placed in the take-out position, it is possible to shorten the duration from the time when a smaller amount than the maximum holding amount of the tray 10, for example, a few documents are loaded on the tray 10 to the time when a document is taken out by the pickup section 30.

More specifically, the time required for displacement of the tray main body 11 from the waiting position Q1 at the time when the maximum holding amount of documents are held on the tray 10 to a position where a document closest to the pickup section 30 held on the tray 10 is placed in the take-out position is one second. On the contrary, the time required for displacement of the tray main body 11 from the preset waiting position Q2 closer to the pickup section 30 than the position Q1 at the time when the maximum holding amount of document are held on the tray 10 to a position where a document closest to the pickup section 30 held on the tray 10 is placed in the take-out position is shorter at least than the time required for displacement from the waiting position Q1 at the time when the maximum holding amount of documents are held on the tray 10 to a position where a document closest to the pickup section 30 held on the tray 10 is placed in the take-out position. Moreover, when the preset waiting position Q2 and a position of the tray main body 11 where a document closest to the pickup section 30 held on the tray 10 is placed in the take-out position are almost the same, the time required for displacement of the tray 10 is almost zero second. Thus, the time required for displacement is largely shortened, and there is no need for displacement of the tray main body 11 in some cases of setting of the waiting position Q2.

Since the amount of handled documents is sufficiently smaller than the maximum holding amount of the tray 10 normally, for example, in the image reading apparatus 2 for reading an image formed on a document, it is possible to perform an image reading process at a high speed by equipping the image reading apparatus 2 with the sheet member feeding and conveying apparatus 1. Moreover, in recent years, images are usually formed on both faces of a document in order to reduce the amount of paper to be used. Since, in this case, the amount of documents handled in the image reading apparatus 2 is further decreased, the image reading apparatus 2 equipped with the sheet member feeding and conveying apparatus 1 of this embodiment is considerably effective.

Further, according to the sheet member feeding and conveying apparatus 1 of this embodiment, the pickup section 30 is driven to be displaced between the pickup position P1 and the evacuation position P2 so as to be, in the feeding state, placed in the pickup position P1 where a document placed in the take-out position can be taken out, and in the waiting state, placed in the evacuated position P2 evacuated from the pickup position P1. When the pickup section 30 is placed in the evacuation position P2, the user can easily remove documents held on the tray 10 from the tray 10. As a result, even when, for example, an undesired document is loaded on the tray 10 by mistake, the user can easily remove the document held on the tray 10 from the tray 10 and easily reload a desired document on the tray 10, so that it is possible to prevent that an undesired document is taken out by the pickup section 30 and processed.

Moreover, according to the sheet member feeding and conveying apparatus 1 of this embodiment, in the waiting state, when it is detected by the document detecting section 40 that a document is loaded on the tray 10, the pickup section 30 placed in the evacuation position P2 is placed in the pickup position P1 after a lapse of the loading completion waiting time from loading of a document. In a case where the pickup section 30 placed in the evacuation position P2 is placed in the pickup position P1 right after it is detected that a document is loaded on the tray 10, once a document is loaded on the tray 10, the held document cannot be removed from the tray 10 because of the pickup section 30 placed in the pickup position P1. However, since the pickup section 30 is placed in the pickup position P1 after a lapse of the loading completion time after it is detected that a document is loaded on the tray 10, the pickup section 30 is placed in the evacuation position P2 during the loading completion waiting time, and therefore, the user can easily remove a document from the tray 10. As a result, even when, for example, an undesired document is loaded on the tray 10 by mistake, the user can easily remove during the loading completion waiting time, and it is possible to prevent that an undesired document is taken out by the pickup section 30 and processed.

Further, according to the sheet member feeding and conveying apparatus 1 of this embodiment, the pickup section 30 is displaced from the evacuation position P2 to the pickup position P1 when a reading instruction is inputted by the operating section 47, and thereafter, controlled so as to take out a document placed in the take-out position. As a result, since the pickup section 30 is placed in the evacuation position P2 during the time between loading a document on the tray 10 and inputting a reading instruction, the user inputs a reading instruction after checking, for example, whether a loaded document is a desired document or not and whether a document is in a predetermined holding state on the tray 10 or not, whereby the pickup section 30 is placed in the pickup position P1. Therefore, it is possible to speedily and certainly take out a document by the pickup section 30.

Although, in the image reading apparatus 2 of this embodiment, a waiting position is set by the user depending on the most frequently set number of documents to be read, and the tray detecting section 41 is mounted to the upper case 5 in a position where, when the tray main body 11 is placed in the waiting position, light emitted from the light transmitting portion of the tray detecting section 41 is reflected on the tray main body 11 and the reflected light enters the light receiving portion of the tray detecting section 41, the waiting position Q2 may be inputted by an input operation of the operating section 47 by the user previously and stored in the storing section 46.

In this case, the position of the tray main body 11 may be detected by, for example, counting the number of pulses given to the tray driving motor 21 of the tray driving section 20. Moreover, the position of the tray main body 11 may be detected by, for example, disposing a rotary encoder to the hinge section connecting the tray main body 11 and the fixed tray portion 12 and detecting an angle formed by the tray main body 11 and the fixed tray 12.

As a result, in the waiting state, the tray main body 11 is driven by the tray driving section 20 to be displaced in the waiting position inputted by the operating section 47, so that it is possible to certainly shorten the duration from the time when documents are loaded on the tray 10 to the time when the documents are taken out by the pickup section 30 by, for example, inputting a waiting position responsive to the amount of documents.

Further, the control section 45 may also function as waiting position determining means and determine a waiting position based on the amount of documents loaded on the tray 10 at the time of an take-out operation executed before. For example, a waiting position is set based on the average value of the numbers of documents in the past fifty to a hundred take-out operations.

As a result, a waiting position is determined based on the amount of documents loaded on the tray 10 at the time of a take-out operation executed before, it is possible to automatically determine a waiting position, and shorten the duration from the time when documents are loaded on the tray 10 to the time when the documents are taken out by the pickup section 30.

Further, according to the sheet member feeding and conveying apparatus 1 and the image reading apparatus 2 of this embodiment, a document passes through the first reading position F1 and the second reading position F2 while at least one surface in the thickness direction of the document makes face contact with the belt 73 of the belt conveying section 70, so that the contact area of a document and conveying means is large and a friction force between a document and conveying means is large as compared with those in a case where a document conveyed while making point contact and line contact with conveying means. As a result, for example, even when an undesired external force acts on a document in the second conveying direction A2, a large friction force between the document and the belt 73 resists the undesired external force, and the document can be stably conveyed in the second conveying direction A2 and passed through the first and second reading positions F1, F2. Thus, since a document stably passes through the first and second reading positions F1, F2, the image reading apparatus 2 is capable of certainly executing a process of reading the document.

Further, according to the sheet member feeding and conveying apparatus 1 of this embodiment, the belt 73 is wound around between the driving roller 71 and the driven roller 72 disposed so as to be rotatable about the axial lines that are parallel with each other, the respective portions of the belt 73 between the rollers 71, 72 become planate, and can certainly make face contact with one surface in the thickness direction of a document. Moreover, since the belt 73 moves between the rollers 71, 72 by the rotation of the driving roller 71 driven to rotate by the conveyance belt driving motor 83, moves between the rollers 71, 72 in the state of making face contact with one surface in the thickness direction of a document, and conveys the document, it is possible to successively move the belt 73 and successively move documents by, for example, controlling the conveyance belt driving motor 83 so as to successively rotate the driving roller 71. Furthermore, for example, by controlling the conveyance belt driving motor 83 so as to cause the driving roller 71 to intermittently make angular displacement, it is possible to intermittently move the belt 73 and intermittently convey documents. Therefore, by controlling the conveyance belt driving motor 83 in accordance with a reading process, it is possible to easily change a mode of conveying documents. In addition, since a friction force between the belt 73 and a document depends on a friction coefficient of the belt 73, it is possible to easily change a friction force between the belt 73 and a document by replacing the belt to one having a friction coefficient responsive to the kind of a document.

Further, according to the sheet member feeding and conveying apparatus 1 of this embodiment, the second conveying path 51, which is a movement path of a document from the belt conveying section 70 to the first and second reading positions F1, F2, is stretched in a planate state, so that a document maintains a planate state without being curved when moving on the second conveying path 51, and therefore, it is possible to prevent generation of a resistance force due to the curvature of a document, and convey a document more stably to pass through the first and second reading positions F1, F2.

Although, in the sheet member feeding and conveying apparatus 1 of this embodiment, the tray driving section 20 is constituted so as to transmit a rotation driving force from the tray driving motor 21 via the gears 22, 23 and so on, cause the driving plate 24 abutting on the other end of the tray main body 11 to make angular displacement and cause the tray main body 11 to make angular displacement, the constitution is not limited to this, and may be a constitution of, by the use of, for example, a wire and a pulley, displacing the whole tray 10 in the longitudinal direction and making it close to and away from the pickup section 30.

Although, in the sheet member feeding and conveying apparatus 1 of this embodiment, documents to be read front the same platen glass 60 in the running reading and both-face reading modes and in the still reading mode, different platen glasses may be used in the running reading and both-face reading modes and in the still reading mode. Besides, a platen glass fronting the first reading position F1 and a platen glass fronting the second reading position F2 may be different bodies.

Further, although the light source of the first scanning portion 101 of the first reading unit 100 is a halogen lamp in the sheet member feeding and conveying apparatus 1 of this embodiment, it is not limited to this, and may be, for example, a xenon lamp and a fluorescent lamp. Moreover, although the second scanning portion 102 of the first reading unit 100 is constituted so as to include the two reflection mirrors 107, 108, the constitution is not limited to this, and a unit of a reduced reading optical system or a unmagnified reading optical system in which at least a CCD, an imaging lens and a light source are integrated may be displaced at the same speed as the first displacement speed V of the first scanning portion 101.

Further, although the column-shaped separation auxiliary roller 52 is disposed so as to front the most upstream portion in the first conveying direction A1 of the first conveying path 50 in the sheet member feeding and conveying apparatus 1 of this embodiment, it is not limited to this and a planate pad whose surface has a large friction coefficient may be placed so as to front the most upstream portion in the first conveying direction A1 of the first conveying path 50, whereby a document is caught between the separation roller 32 and the pad, and when the separation roller 32 is rotated, only a document making contact with the separation roller 32 is separated and conveyed toward the first conveying direction A1 on the first conveying path 50.

Further, although the first conveying path is bent and stretched curvedly in the sheet member feeding and conveying apparatus 1 and the image reading apparatus 2 of this embodiment, it may be stretched in a planate state in accordance with the placement position of the tray 10.

Further, in the sheet member feeding and conveying apparatus 1 of this embodiment, in a case where the amount of documents loaded on the tray 10 is more than the maximum holding amount, the pickup section 30 is not placed in the pickup position P1 even when an electric current is passed through the solenoid 34, the pickup section 30 is driven to be displaced from the evacuation position P2 toward the pickup position P1 and the tray driving section 20 is controlled. Therefore, the control section 45 may be constituted so as to, in this case, display a warning that the amount of documents on the tray 10 is more than the maximum holding amount on the operating section 47 and inform the user.

Although the driving roller 71 is a column-shaped roller at least whose peripheral portion is made of a resin such as polyacetal in the sheet member feeding and conveying apparatus 1 of this embodiment, it is not limited to this and, may be made of metal such as iron, stainless steel and aluminum, and the shape thereof may be a column-shaped gear on whose peripheral portion tooth grooves are incised. Moreover, although, regarding the driven roller 72, at least peripheral portion is made of a resin such as polyacetal, it is not limited to this and, may be made of metal such as iron, stainless steel and aluminum.

Although the belt is an endless belt made of urethane rubber in the sheet member feeding and conveying apparatus 1 of this embodiment, it is not limited to this, and may be an endless belt made of neoprene, ethylene propylene diene rubber or acrylic nitrile butadiene rubber.

Further, although the sheet member feeding and conveying apparatus 1 of this embodiment is mounted on the image reading apparatus 2, even when an apparatus including at least tray 10, the tray driving section 20, the pickup section 30, the document detecting section 40, the tray detecting section 41, the pickup detecting section 42, the control section 45, the storing section 46 and the pickup driving motor 81 of the sheet member feeding and conveying apparatus 1 is mounted onto an image forming apparatus such as a printer, it is possible to obtain the same effect as in the aforementioned image reading apparatus 2.

The invention may be embodied in other specific forms without departing from the spirit or essential characteristics thereof. The embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A sheet member feeding and conveying apparatus comprising:

pickup means for taking out a sheet member placed in a predetermined take-out position;

a tray having a tray main body capable of displacement in directions close to and away from the pickup means, for holding sheet members;

tray driving means for driving the tray main body to be displaced in the directions close to and away from the pickup means; and control means for controlling the tray driving means so as to, in a feeding state of feeding sheet members held on the tray, drive the tray main body to be displaced so that a sheet member closest to the pickup means held on the tray is placed in the take-out position, and in a waiting state of waiting for loading of sheet members on the tray, drive the tray main body to be displaced into a waiting position which is closer to the pickup means than a position at a time when a maximum holding amount of sheet members are held on the tray.

2. The sheet member feeding and conveying apparatus of claim 1, further comprising:

waiting position input means for inputting a waiting position, wherein, in the waiting state, the control means controls the tray driving means so as to drive the tray main body to be displaced into a waiting position inputted by the waiting position input means.

3. The sheet member feeding and conveying apparatus of claim 1, further comprising:

waiting position determining means for determining a waiting position based on the amount of sheet members loaded on the tray in a take-out operation executed before.

4. The sheet member feeding and conveying apparatus of claim 1, wherein the pickup means is capable of displacement between a pickup position where a sheet member placed in a take-out position can be taken out and an evacuation position evacuated from the pickup position, further comprising:

pickup driving means for driving the pickup means to be displaced between the pickup position and the evacuation position, and wherein the control means controls the pickup driving means so as to, in the feeding state, place the pickup means into the pickup position, and in the waiting state, place the pickup means into the evacuation position.

5. The sheet member feeding and conveying apparatus of claim 4, further comprising:

sheet member detecting means for detecting that a sheet member is held on the tray, wherein, in the waiting state, when the sheet member detecting means detects that a sheet member is loaded on the tray, the control means controls the pickup driving means so as to place the pickup means placed in the evacuation position into the pickup position after a lapse of preset loading completion waiting time for waiting for a time between loading of a sheet member and completion of loading.

6. The sheet member feeding and conveying apparatus of claim 5, further comprising:

loading completion waiting time input means for inputting loading completion waiting time.

7. The sheet member feeding and conveying apparatus of claim 5, further comprising:

take-out request input means for inputting a request for taking out a sheet member, wherein the control means controls the pickup driving means so as to displace the pickup means into the evacuation position in a case where, after the pickup means is displaced from the evacuation position into the pickup position, a take-out request is not inputted after a lapse of preset request waiting time for waiting for input of a take-out request.

8. The sheet member feeding and conveying apparatus of claim 7, further comprising:

request waiting time input means for inputting request waiting time.

9. The sheet member feeding and conveying apparatus of claim 4, further comprising:

feeding request input means for inputting a request for feeding a sheet member, wherein, when a feeding request is inputted, the control means controls the pickup driving means so as to displace the pickup means placed in the evacuation position into the pickup position, and after displacement into the pickup position, controls the pickup means so as to take out a sheet member placed in the take-out position.

* * * * *